US009869454B2

(12) United States Patent
Kim et al.

(10) Patent No.: US 9,869,454 B2
(45) Date of Patent: Jan. 16, 2018

(54) LIGHT-EMITTING APPARATUS

(71) Applicant: LG INNOTEK CO., LTD., Seoul (KR)

(72) Inventors: Ki Cheol Kim, Seoul (KR); Chang Gyun Son, Seoul (KR); Kang Yeol Park, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 153 days.

(21) Appl. No.: 14/929,291

(22) Filed: Oct. 31, 2015

(65) Prior Publication Data

US 2016/0131335 A1 May 12, 2016

(30) Foreign Application Priority Data

Nov. 11, 2014 (KR) ..... 10-2014-0156036

(51) Int. Cl.

| | |
|---|---|
| ***F21V 13/04*** | (2006.01) |
| ***F21V 9/16*** | (2006.01) |
| ***F21V 5/08*** | (2006.01) |
| ***F21V 19/00*** | (2006.01) |
| ***F21V 13/12*** | (2006.01) |
| ***F21K 9/64*** | (2016.01) |
| ***F21S 8/10*** | (2006.01) |

(Continued)

(52) U.S. Cl.

CPC ..... *F21V 13/04* (2013.01); *F21K 9/64* (2016.08); *F21S 48/1145* (2013.01); *F21V 5/08* (2013.01); *F21V 9/16* (2013.01); *F21V 13/12* (2013.01); *F21V 19/0015* (2013.01); *F21V 7/0008* (2013.01); *F21V 7/0066* (2013.01); *F21Y 2115/10* (2016.08); *F21Y 2115/30* (2016.08)

(58) Field of Classification Search

CPC ... F21V 13/04; F21V 5/08; F21V 9/16; F21V 13/12; F21V 19/0015; F21V 7/0008; F21V 7/0066; F21Y 2115/30; F21Y 2115/10; F21K 9/64; F21S 48/1145

USPC ..... 362/84, 510, 520, 538

See application file for complete search history.

(56) References Cited

U.S. PATENT DOCUMENTS

2012/0314442 A1 12/2012 Takahashi et al.
2013/0027962 A1* 1/2013 Takahashi ..... F21S 48/1145 362/538

(Continued)

FOREIGN PATENT DOCUMENTS

| | | |
|---|---|---|
| JP | 2012-190551 A | 10/2012 |
| WO | 2013-178415 A1 | 12/2013 |
| WO | 2014-043384 A1 | 3/2014 |

OTHER PUBLICATIONS

European search report for European Patent Application No. 15193632.5 corresponding to the above-referenced U.S. application.

*Primary Examiner* — Laura Tso

(74) *Attorney, Agent, or Firm* — LRK Patent Law Firm

(57) ABSTRACT

Embodiments provide a light-emitting apparatus including at least one light source, a wavelength converter configured to convert a wavelength of light emitted from the light source, a reflector configured to reflect the light having the wavelength converted in the wavelength converter and light having an unconverted wavelength, and a refractive member disposed in a light passage space between the reflector and the wavelength converter, the refractive member being configured to emit the reflected light.

20 Claims, 29 Drawing Sheets

(51) Int. Cl.

| | |
|---|---|
| *F21V 7/00* | (2006.01) |
| *F21Y 115/30* | (2016.01) |
| *F21Y 115/10* | (2016.01) |

(56) References Cited

U.S. PATENT DOCUMENTS

| | | | | |
|---|---|---|---|---|
| 2013/0188381 | A1 | 7/2013 | Kotani | |
| 2014/0098541 | A1 | 4/2014 | Kamee et al. | |
| 2014/0168940 | A1* | 6/2014 | Shiomi ..... | B60Q 1/0023 362/84 |
| 2014/0168942 | A1 | 6/2014 | Kishimoto et al. | |
| 2014/0268846 | A1 | 9/2014 | Nakazato | |

* cited by examiner

LIGHT-EMITTING APPARATUS

CROSS REFERENCE TO RELATED APPLICATION

This application claims priority under 35 U.S.C. §119 to Korean Patent Application No. 10-2014-0156036, filed in Korea on 11 Nov. 2014, which is hereby incorporated in its entirety by reference as if fully set forth herein.

BACKGROUND OF THE INVENTION

1. Field of the Invention

Embodiments relate to a light-emitting apparatus.

2. Description of Related Art

Semiconductor Light-Emitting Diodes (LEDs) are semiconductor devices that convert electricity into infrared light or ultraviolet light using the characteristics of compound semiconductors so as to enable transmission/reception of signals, or that are used as a light source.

Group III-V nitride semiconductors are in the spotlight as core materials of light emitting devices such as, for example, LEDs or Laser Diodes (LDs) due to physical and chemical characteristics thereof.

The LEDs or LDs do not include environmentally harmful materials such as mercury (Hg) that are used in conventional lighting appliances such as, for example, fluorescent lamps and incandescent bulbs, and thus are very eco-friendly, and have several advantages such as, for example, long lifespan and low power consumption. As such, conventional light sources are being rapidly replaced with LEDs or LDs.

In particular, the fields in which these light-emitting devices are used are expanding to include, for example, headlights for vehicles and flashlights. A light-emitting apparatus including light-emitting devices needs to have, for example, excellent light extraction efficiency and radiation effects, and demand for a reduction in the size and weight of light-emitting apparatuses is continuously increasing.

SUMMARY

Embodiments provide a light-emitting apparatus having improved reliability owing to excellent light extraction efficiency and radiation effects.

In one embodiment, a light-emitting apparatus includes at least one light source, a wavelength converter configured to convert a wavelength of light emitted from the light source, a reflector configured to reflect the light having the wavelength converted in the wavelength converter and light having an unconverted wavelength, and a refractive member filled in a light passage space between the reflector and the wavelength converter, the refractive member being configured to emit the reflected light.

For example, the refractive member may include a rounded first surface disposed to face the reflector, a second surface having a first portion disposed to face the wavelength converter, and a third surface for emission of the reflected light.

For example, the light-emitting apparatus may further include a base substrate disposed to be opposite to the reflector with the refractive member interposed therebetween, or to be opposite to the refractive member with the reflector interposed therebetween. The base substrate may come into contact with the refractive member.

For example, the base substrate may include first and second areas adjacent to each other, the first area may correspond to an area excluding the second area, or an area facing a second portion, excluding the first portion, of the second surface of the refractive member that, and the second area may correspond to an area for arrangement of the wavelength converter.

For example, the second area of the base substrate may include a first through hole for passage of the light emitted from the light source, and the wavelength converter may be located in the first through-hole. The first through-hole may be located closer to the first surface of the refractive member than the third surface of the refractive member.

For example, the reflector may include a second through-hole for passage of the light emitted from the light source. The reflector may have one end coming into contact with the third surface of the refractive member and the other end coming into contact with the base substrate, and a first distance from the second through-hole to the one end of the reflector may be greater than a second distance from the second through-hole to the other end of the reflector. The second area of the base substrate may include a recess for arrangement of the wavelength converter. The light-emitting apparatus may further include a second reflective layer disposed in the recess between the wavelength converter and the base substrate. The second reflective layer may be a film or a coating attached to the wavelength converter or the base substrate. The wavelength converter may be disposed on the second area of the base substrate so as to be rotatable to face the second through-hole.

For example, the light source may be spaced apart from the wavelength converter or the reflector by a distance of 10 μm or more.

For example, the light-emitting apparatus may further include a first reflective layer disposed between at least a part of the second portion of the refractive member and the first area of the base substrate. The first reflective layer may be a film or a coating attached to the second portion of the refractive member or the first area of the base substrate.

For example, the light-emitting apparatus may further include a light transmitting layer disposed between the light source and the first or second through-hole. The light transmitting layer may include a material having an index of refraction of 1 or 2.

For example, in order to allow the light refracted by the refractive member to travel in a direction parallel to the normal of the wavelength converter, at least one of a rotation angle of the wavelength converter or an incident angle of light from the light source to the second through-hole may be adjusted.

For example, at least one of the second portion of the refractive member or the first area of the base substrate may have a pattern.

For example, the pattern may include at least one of a semispherical shape, a circular shape, a conical shape, a truncated conical shape, a pyramidal shape, a truncated pyramidal shape, a reversed conical shape, or a reversed pyramidal shape.

For example, the pattern may include at least one of a circular shape, a dot shape, a lattice shape, a horizontal line shape, a vertical line shape, or a ring shape.

For example, the reflector and the refractive member may be integrated with each other.

For example, the refractive member may include at least one of $Al_2O_3$ single crystals, $Al2O_3$, or $SiO_2$ glass. The refractive member may include a material having a thermal conductivity coefficient within a range from 1 W/mK to 50 W/mK. The refractive member may include a material having a reference temperature within a range from 20K to 400K. The first surface of the refractive member may have a parabolic shape, and the first surface and the second surface of the refractive member may have a parabolic shape. In this case, the first surface of the refractive member may have bilaterally symmetrical cross-sectional shapes with the second surface as the center.

For example, the light-emitting apparatus may further include an anti-reflective film disposed on the third surface of the refractive member.

For example, the reflector may include at least one of an aspherical surface, a freeform curved surface, a Fresnel lens, or a holography optical element.

For example, the third surface of the refractive member may include at least one of a flat surface, a curved surface, an aspherical surface, a total internal reflective surface, or a freeform curved surface.

For example, at least one of the reflector, the first reflective layer, and the second reflective layer may have a reflectance within a range from 60% to 100%.

For example, the reflector may include a metal layer coated on the first surface of the refractive member.

For example, the wavelength converter may include at least one of phosphors, lumiphors, ceramic phosphors, and YAG single-crystals. The wavelength converter may be a PIG type, a polycrystalline type, or a single-crystalline type. The light having the wavelength converted in the wavelength converter may have a color temperature within a range from 3000K to 9000K. The first index of refraction of the wavelength converter may be within a range from 1.3 to 2.0.

For example, the second surface of the refractive member may have a diameter within a range from 10 mm to 100 mm. The ratio of the area of a spectral full width at half maximum of light having the wavelength converted in the wavelength converter to the area of the second surface or the third surface of the refractive member may be within a range from 0.001 to 1.

For example, the light-emitting apparatus may further include a first adhesive part disposed between the first portion of the second surface of the refractive member and the wavelength converter. The first adhesive part may include at least one of sintered or fired polymer, $Al_2O_3$, or $SiO_2$.

For example, the light-emitting apparatus may further include a second adhesive part disposed between the second portion of the second surface of the refractive member and the first area of the base substrate.

For example, the light source may include at least one of light-emitting diodes or laser diodes. The light source may emit light in a wavelength band within a range from 400 nm to 500 nm. The light source may emit light having a spectral full width at half maximum of 10 nm or less, and the spectral full width at half maximum of light introduced into the wavelength converter may be 1 nm or less.

For example, the at least one light source may include a plurality of light sources, and the light-emitting apparatus may further include a circuit board for mounting of the light sources. The light-emitting apparatus may further include a radiator attached to a rear surface of the circuit board or a rear surface of the base substrate. A surface of the circuit board for the mounting of the light sources may be a flat surface, a curved surface, or a spherical surface.

For example, the at least one light source may include a plurality of light sources, and the light-emitting apparatus may further include at least one first lens configured to focus the light emitted from the light sources so as to emit the light to the first or second through-hole.

For example, the light-emitting apparatus may further include a first mirror disposed between the first lens and the first or second through-hole.

For example, the light-emitting apparatus may further include a prism, a second mirror, or a dichroic coating layer, disposed between the light sources and the at least one first lens.

BRIEF DESCRIPTION OF THE DRAWINGS

Arrangements and embodiments may be described in detail with reference to the following drawings in which like reference numerals refer to like elements and wherein.

DESCRIPTION OF SPECIFIC EMBODIMENTS

Figure 1:
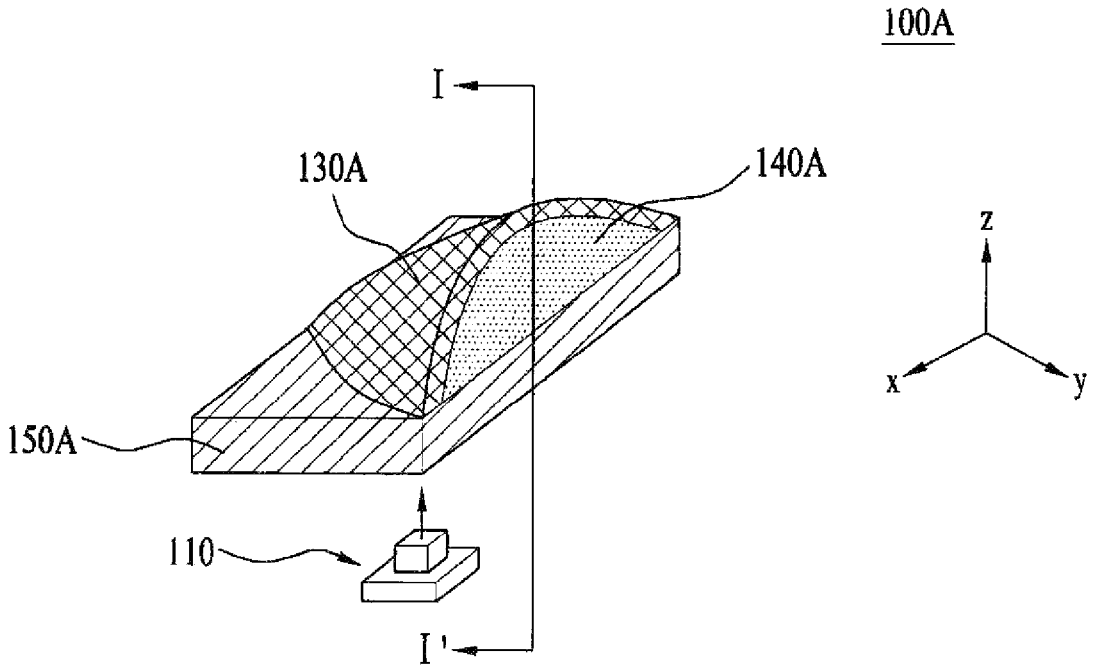
FIG. 1 is a perspective view of a light-emitting apparatus according to one embodiment.

Hereinafter, exemplary embodiments will be described in detail with reference to the accompanying drawings to aid in understanding of the embodiments. However, the embodiments may be altered in various ways, and the scope of the embodiments should not be construed as limited to the following description. The embodiments are intended to provide those skilled in the art with more complete explanation.

In the following description of the embodiments, it will be understood that, when each element is referred to, as being formed "on" or "under" the other element, it can be directly "on" or "under" the other element or be indirectly formed with one or more intervening elements therebetween. In addition, it will also be understood that "on" or "under" the element may mean an upward direction and a downward direction of the element.

In addition, the relative terms "first", "second", "upper", "lower" and the like in the description and in the claims may be used to distinguish between any one substance or element and other substances or elements and not necessarily for describing any physical or logical relationship between the substances or elements or a particular order.

In the drawings, the thickness or size of each layer (or each portion) may be exaggerated, omitted or schematically illustrated for clarity and convenience. In addition, the size of each constituent element does not wholly reflect an actual size thereof.

Hereinafter, light-emitting apparatuses 100A to 100I according to the embodiments will be described with reference to the accompanying drawings. For convenience, although the light-emitting apparatuses 100A to 100I will be described using the Cartesian coordinate system (comprising the x-axis, the y-axis, and the z-axis), of course, it may be described using other coordinate systems. In addition, although the x-axis, the y-axis, and the z-axis in the Cartesian coordinate system are perpendicular to one another, the embodiments are not limited thereto. That is, the x-axis, the y-axis, and the z-axis may cross one another, rather than being perpendicular to one another.

Figure 2:
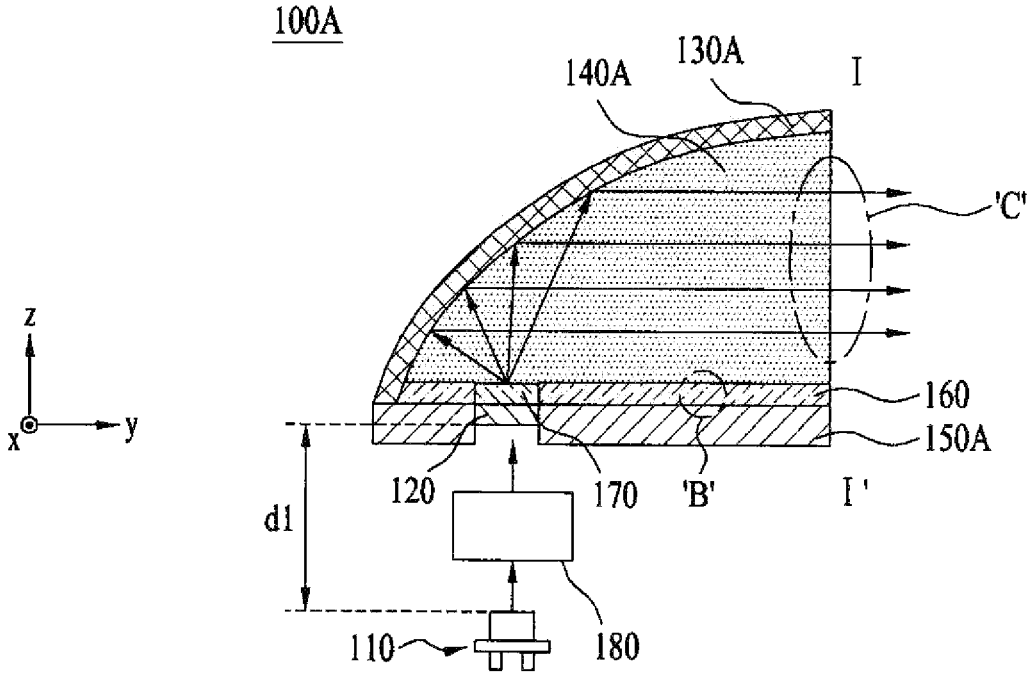
FIG. 2 is a sectional view taken along line I-I' of the light-emitting apparatus illustrated in FIG. 1.
Figure 3:
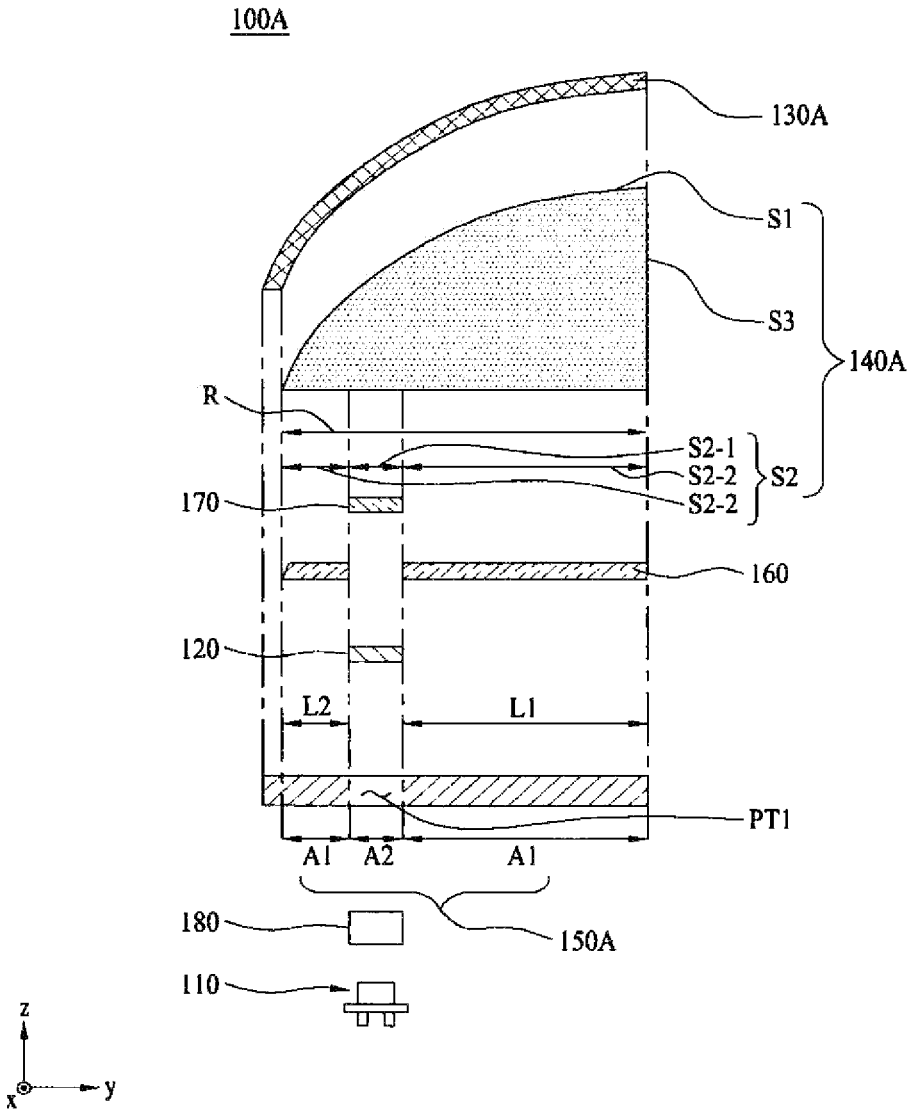
FIG. 3 is an, exploded sectional view of the light-emitting apparatus illustrated in FIG. 2.

FIG. 1 is a perspective view of the light-emitting apparatus 100A according to one embodiment, FIG. 2 is a sectional view taken along line I-I' of the light-emitting apparatus 100A illustrated in FIG. 1, and FIG. 3 is an exploded sectional view of the light-emitting apparatus 100A illustrated in FIG. 2. In FIG. 1, a light transmitting layer 180 illustrated in FIGS. 2 and 3 is omitted.

The light-emitting apparatus 100A of one embodiment may include a light source 110, a wavelength converter 120, a reflector 130A, a refractive member 140A, a substrate 150A, a first reflective layer 160, a first adhesive part 170, and a light transmitting layer 180.

The light source 110 serves to emit light. Although the light source 110 may include at least one of Light-Emitting Diodes (LEDs) or Laser Diodes (LDs), the embodiment is not limited as to the kind of the light source 110.

Generally, the viewing angle of LEDs is wider than the viewing angle of LDs. Thus, LDs having a narrower viewing angle than LEDs may be advantageous in terms of the introduction of light into a first through-hole PT1. However, in the case where an optical system (not illustrated) capable of reducing the viewing angle is located between the light source 110, i.e. the LEDs and the first through-hole PT1, the optical system may reduce the viewing angle of light emitted from the LEDs so as to introduce the light into the first through-hole PT1. As such, the LEDs may be used as the light source 110.

In the case of FIG. 1, although only one light source 110 is illustrated, the embodiment is not limited as to the number of light sources 110. That is, a plurality of light sources 110 may be provided.

In addition, although the light emitted from the light source 110 may have any peak wavelength in the wavelength band from 400 nm to 500 nm, the embodiment is not limited as to the wavelength band of the emitted light. The light source 110 may emit light having a Spectral Full Width at Half Maximum (SFWHM) of 10 nm or less. The SFWHM corresponds to the width of a wavelength depending on intensity. However, the embodiment is not limited to any specific value of the SFWHM. In addition, although the FWHM of light, emitted from the light source 110 and introduced into the wavelength converter 120, i.e. the size of light beams may be 1 nm or less, the embodiment is not limited thereto.

In addition, the light transmitting layer 180 may be additionally disposed in a path along which the light emitted from the light source 110 passes toward the wavelength converter 120. That is, the light transmitting layer 180 may be located between the light source 110 and the first through-hole PT1. The light transmitting layer 180 may include a transparent medium, the index of refraction of which is 1, the same as that of air, or may include a transparent medium, the index of refraction of which is greater than 1 and equal to or less than 2. In some cases, the light-emitting apparatus 100A may not include the light transmitting layer 180.

In the case of FIGS. 2 and 3, although the light transmitting layer 180 is illustrated as being, spaced apart from the wavelength converter 120 and the substrate 150A and being also spaced apart from the light source 110, the embodiment is not limited thereto. That is, in another embodiment, unlike the illustration of FIGS. 2 and 3, the light transmitting layer 180 may be located in contact with at least one of the wavelength converter 120, the substrate 150A, or the light source 110. That is, the light emitted from the light source 110 may be introduced into the wavelength converter 120 by way only of the light transmitting layer 180 without passing through air.

The light source 110 may be spaced apart from the wavelength converter 120 (or the first through-hole PT1) by a first distance d1. When the first distance d1 is small, the wavelength converter 120 may be affected by heat generated from the light source 110. Therefore, although the first distance d1 may be 10 μm or more, the embodiment is not limited thereto.

Meanwhile, the wavelength converter 120 may convert the wavelength of the light emitted from the light source 110. While the light emitted from the light source 110 is introduced into the first through-hole PT1 and passes through the wavelength converter 120, the wavelength of the light may vary. However, not all of the light that has passed through the wavelength converter 120 may be wavelength-converted light.

As the wavelength of the light emitted from the light source 110 is converted by the wavelength converter 120, white light or light having a desired color temperature may be emitted from the light-emitting apparatus 100A. To this end, the wavelength converter 120 may include phosphors, for example, at least one of ceramic phosphors, lumiphors, and YAG single-crystals. Here, the term "lumiphors" means a luminescent material or a structure including a luminescent material.

In addition, light having a desired color temperature may be emitted from the light-emitting apparatus 100A via adjustment in, for example, the concentration, particle size, and particle-size distribution of various materials included in the wavelength converter 120, the thickness of the wavelength converter 120, the surface roughness of the wavelength converter 120, and air bubbles. For example, the wavelength converter 120 may convert the wavelength band of light having a color temperature within a range from 3000K to 9000K. That is, although the light, the wavelength of which has been converted by the wavelength converter 120, may be within the color temperature range from 3000K to 9000K, the embodiment is not limited thereto.

The wavelength converter 120 may be any of various types. For example, the wavelength converter 120 may be any of three types, i.e. a Phosphor-In-Glass (PIG) type, a polycrystalline type (or ceramic type), and a single-crystalline type.

The wavelength converter 120 may be disposed on the base substrate 150A. The base substrate 150A may include a first area A1 and a second area A2. The first area A1 of the base substrate 150A may be defined as the area that faces a second portion S2-2, excluding a first portion S2-1, at a second surface S2 of the refractive member 140A which will be described below. Alternatively, in FIG. 3, the first area A1 may be defined as the area of the base substrate 150A excluding the second area A2. The second area A2 of the base substrate 150A may be defined as the area that is adjacent to the first area A1 and supports the wavelength converter 120 disposed thereon. The second area A2 of the base substrate 150A may include the first through-hole PT1, into which the light emitted from the light source 110 is introduced. The wavelength converter 120 may be disposed in the first through-hole PT1 of the second area A2 of the base substrate 150A.

The base substrate 150A may directly contact the refractive member 140A as exemplarily illustrated in FIG. 1, and the first reflective layer 160 may be interposed between the base substrate 150A and the refractive member 140A as exemplarily illustrated in FIG. 2. In addition, the base substrate 150A may be opposite to the reflector 130A with the refractive member 140A interposed therebetween.

The reflector 130A may reflect light, the wavelength of which has been converted in the wavelength converter 120 as well as light, the wavelength of which has not been converted in the wavelength converter 120. In addition, the reflector 130A may include at least one selected, based on the desired illuminance distribution, from an aspherical surface, a freeform curved surface, a Fresnel lens, and a Holography Optical Element (HOE). Here, the freeform curved surface may be a form provided with curvilinear surfaces in various shapes.

When the Fresnel lens is used as the reflector 130A, the Fresnel lens may serve as a reflector 130A that reflects light, the wavelength of which has been converted in the wavelength converter 120, as well as light, the wavelength of which has not been converted.

Meanwhile, the refractive member 140A may fill the space for the passage of light between the reflector 130A and the wavelength converter 120 and serve to refract the light introduced into the first through-hole PT1 or to emit the light reflected by the reflector 130A. The light emitted from the light source 110 is introduced through the first through-hole PT1, and thereafter passes through the wavelength converter 120. At this time, when the light, directed to the reflector 130A after passing through the wavelength converter 120, is introduced into the refractive member 140A by way of the air, the light may be refracted in the refractive member 140A due to the difference in the index of refraction between the air and the refractive member 140A (or the wavelength converter 120).

Therefore, according to the embodiment, the refractive member 140A is disposed to fill the entire space, through which the light is directed toward the reflector 130A after passing through the wavelength converter 120, thereby ensuring that no air is present in the space through which the light, having passed through the wavelength converter 120, passes. As a result, the light having passed through the wavelength converter 120 may travel to the reflector 130A by way only of the refractive member 140A, without passing through the air, and the light reflected by the reflector 130A may be emitted to the air through a third surface S3, which will be described hereinafter, after passing through the refractive member 140A.

In addition, the smaller the difference Δn between the first index of refraction n1 of the wavelength converter 120 and the second index of refraction n2 of the refractive member 140A, the greater the improvement in the light extraction efficiency of the light-emitting apparatus 100A. However, when the difference Δn between the first and second indices of refraction n1 and n2 is large, the improvement in the light extraction efficiency of the light-emitting apparatus 100A may be reduced.

The following Table 1 represents the relationship between the difference Δn between the first index of refraction n1 and the second index of refraction n2 and light extraction efficiency.

TABLE 1

| n1 | n2 | Δn | Ext(%) | ΔExt(%) |
|---|---|---|---|---|
| 1.4 | 1.0 | 0.4 | 30.01 | 0.00 |
| (202, 212 in | 1.1 | 0.3 | 38.14 | 8.13 |
| FIGS. 4A, 4B) | 1.2 | 0.2 | 48.49 | 18.48 |
| | 1.3 | 0.1 | 62.88 | 32.87 |
| | 1.4 | 0 | 100.00 | 69.99 |
| 1.6 | 1.0 | 0.6 | 21.94 | 0.00 |
| (204, 214 in | 1.1 | 0.5 | 27.38 | 5.44 |
| FIGS. 4A, 4B) | 1.2 | 0.4 | 33.86 | 11.92 |
| | 1.3 | 0.3 | 41.70 | 19.77 |
| | 1.4 | 0.2 | 51.59 | 29.65 |
| | 1.5 | 0.1 | 65.20 | 43.26 |
| | 1.6 | 0 | 100.00 | 78.06 |
| 1.8 | 1.0 | 0.8 | 16.85 | 0.00 |
| (206, 216 in | 1.1 | 0.7 | 20.85 | 3.99 |
| FIGS. v4A, 4B) | 1.2 | 0.6 | 25.46 | 8.61 |
| | 1.3 | 0.5 | 30.83 | 13.98 |
| | 1.4 | 0.4 | 37.15 | 20.29 |
| | 1.5 | 0.3 | 44.72 | 27.87 |
| | 1.6 | 0.2 | 54.19 | 37.34 |
| | 1.7 | 0.1 | 67.13 | 50.28 |
| | 1.8 | 0 | 100.00 | 83.15 |
| 2.0 | 1.0 | 1.0 | 13.40 | 0.00 |
| (208, 218 in | 1.1 | 0.9 | 16.48 | 3.09 |
| FIGS. 4A, 4B) | 1.2 | 0.8 | 20.00 | 6.60 |
| | 1.3 | 0.7 | 24.01 | 10.61 |
| | 1.4 | 0.6 | 28.59 | 15.19 |
| | 1.5 | 0.5 | 33.86 | 20.46 |
| | 1.6 | 0.4 | 40.00 | 26.60 |
| | 1.7 | 0.3 | 47.32 | 33.92 |
| | 1.8 | 0.2 | 56.41 | 43.01 |
| | 2.0 | 0 | 100.00 | 86.60 |

Here, Ext is light extraction efficiency, and ΔExt is variation in light extraction efficiency Ext.

Figure 4A:
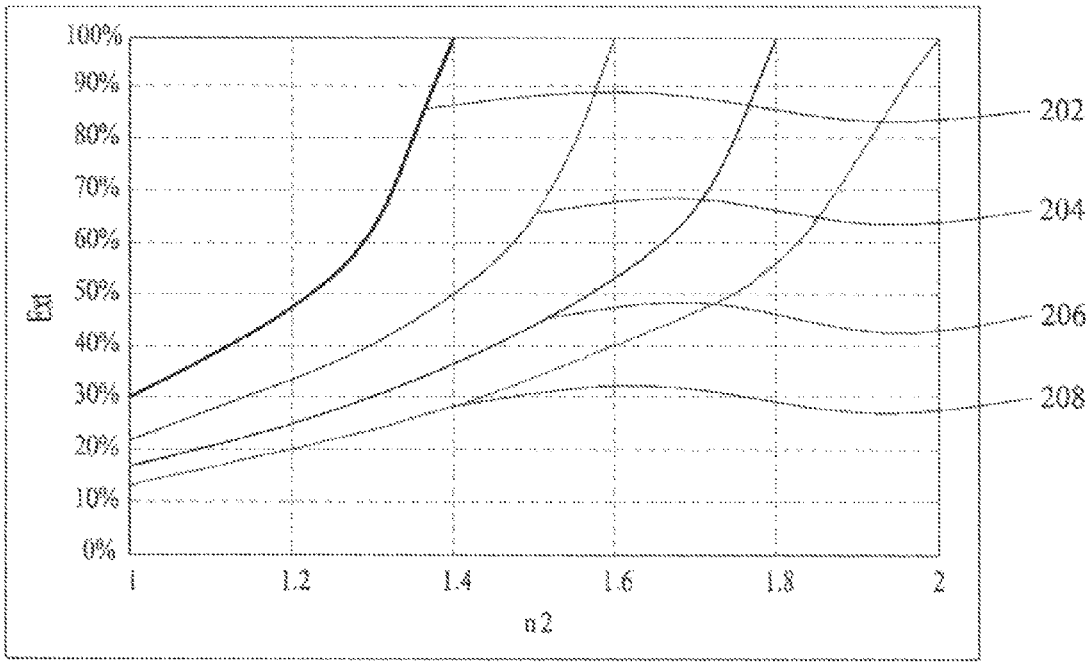
FIG. 4A is a graph illustrating light extraction efficiency depending on the second index of refraction.
Figure 4B:
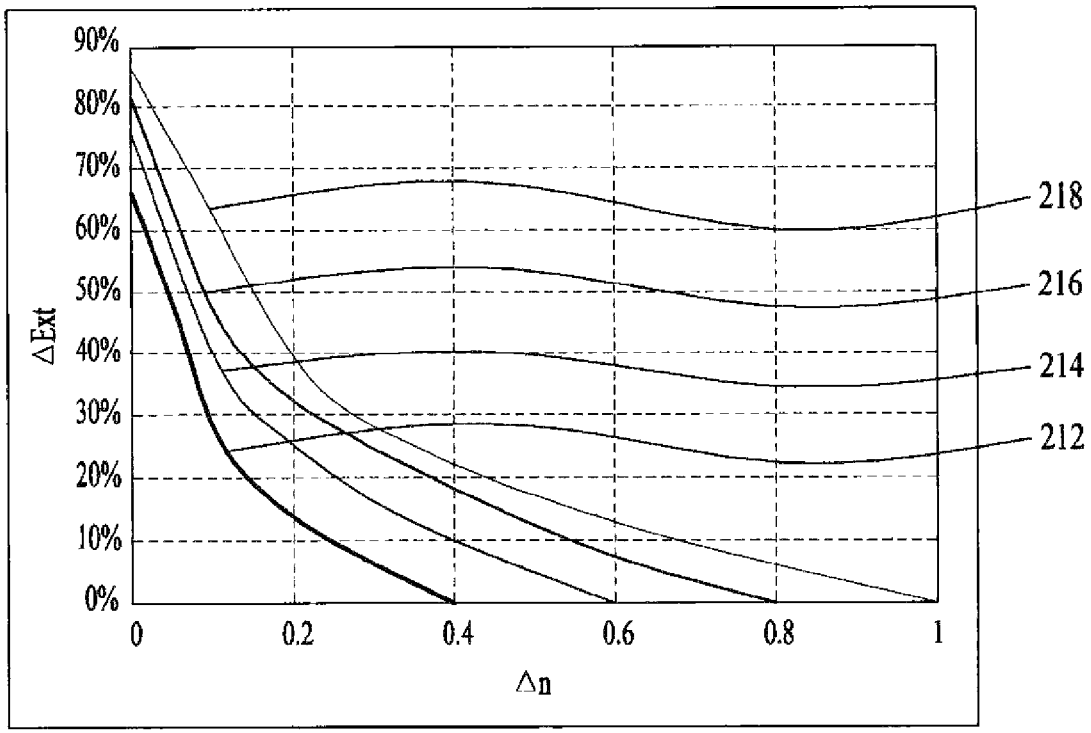
FIG. 4B is a graph illustrating variation in light extraction efficiency depending on the difference in the index of refraction.

FIG. 4A is a graph, illustrating light extraction efficiency Ext depending on the second index of refraction n2, and FIG. 4B is a graph illustrating variation in light extraction efficiency ΔExt depending on the difference in the index of refraction Δn.

Referring to Table 1 and FIGS. 4A and 4B, it can be appreciated that light extraction efficiency increases as the difference Δn between the first and second indices of refraction n1 and n2 decreases. Thus, although the difference Δn between the first and second indices of refraction n1 and n2 may be zero (i.e. when the first and second indices of refraction n1 and n2 are the same), the embodiment is not limited thereto.

The first index of refraction n1 may be changed according to the shape of the wavelength converter 120. When the wavelength converter 120 is a PIG type, the first index of refraction n1 may be within a range from 1.3 to 1.7. When the wavelength converter 120 is a polycrystalline type, the first index of refraction n1 may be within a range from 1.5 to 2.0. When the wavelength converter 120 is a single-crystalline type, the first index of refraction n1 may be within a range from 1.5 to 2.0. As such, although the first index of refraction n1 may be within a range from 1.3 to 2.0, the embodiment is not limited thereto.

The refractive member 140A may be formed of a material having a high second index of refraction n2. For example, the refractive member 140A may comprise at least one of $Al_2O_3$ single-crystals, and $Al_2O_3$ or $SiO_2$ glass. As described above, the material of the refractive member 140A may be selected to have a second index of refraction n2 having a small difference Δn with the first index of refraction n1.

In addition, when the refractive member 140A has high thermal conductivity, the refractive member 140A may advantageously radiate heat generated from the wavelength converter 120. The thermal conductivity may be changed based on the kind of material and the reference temperature (i.e. the temperature of the surrounding environment). In consideration thereof, the refractive member 140A may comprise a material having thermal conductivity within a range from 1 W/mK to 50 W/mK and/or a reference temperature within a range from 20K to 400K.

As described above, the material of the refractive member 140A may be determined in consideration of the fact that light extraction efficiency and heat radiation are determined based on the kind of material of the refractive member 140A.

Referring again to FIGS. 2 and 3, the refractive member 140A may include first, second, and third surfaces S1, S2, and S3. The first surface S1 of the refractive member 140A is defined as the surface that faces the reflector 130A and has a rounded cross-sectional shape. The second surface S2 includes at least one of first or second portions S2-1 or S2-2. The first portion S2-1 of the second surface S2 may be defined as the surface that faces the wavelength converter 120, and the second portion S2-2 may be defined as the portion of the second surface S2 excluding the first portion S2-1. The third surface S3 may be defined as the surface, from which the light reflected by the reflector 130A is emitted.

In addition, although the first surface S1 of the refractive member 140A (or the reflector 130A) may have a parabolic shape, the embodiment is not limited as to the shape of the first surface S1. When the first surface S1 has a parabolic shape, this may be advantageous for the collimation of light emitted through the third surface S3.

In addition, the optimal position of the wavelength converter 120 on the base substrate 150A in the horizontal direction (e.g., the y-axis) may be determined based on various factors, for example, the shape of the reflector 130A.

In one example, when the reflector 130A has an aspherical surface or a freeform curved surface, the first through-hole PT1 formed in the base substrate 150A may be located closer to the first surface S1 of the refractive member 140A, which faces the reflector 130A, than to the third surface S3 of the refractive member 140A, from which the light is emitted. In this case, the wavelength converter 120 is located closer to the first surface S1 than to the third surface S3. That is, the first through-hole PT1 may be spaced apart from the third surface S3 by a first distance L1, and may be spaced apart from the end of the first surface S1 by a second distance L2. This is because, in some cases, a greater amount of light may be reflected by the reflector 130A when the second distance L2 is smaller than the first distance L1. However, the embodiment is not limited thereto.

In another example, when the reflector 130A has a parabolic shape, the position of the wavelength converter 120 may correspond to the focal point of the parabola. Accordingly, in this case, it is not necessary to set the second distance L2 to be smaller than the first distance L1 as described above, in order to cause a great amount of light to be reflected by the reflector 130A.

The reflector 130A may include a metal layer coated over the first surface S1 of the refractive member 140A. That is, the reflector 130A may be formed by coating the first surface S1 of the refractive member 140A with a metal.

The reflector 130A and the refractive member 140A may be integrated with each other. In this case, the refractive member 140A may serve not only as a lens, but also as a reflector. When the reflector 130A and the refractive member 140A are integrated with each other as described above, the light directed to the reflector 130A after passing through the wavelength converter 120 may have no possibility of coming into contact with the air.

In addition, each of the refractive member 140A and the base substrate 150A may have at least one of a 2-dimensional pattern or a 3-dimensional pattern, based on the desired illuminance distribution of the light-emitting apparatus 100A.

FIGS. 5A to 5G are enlarged partial sectional views of embodiments B1 to B7 of portion "B" illustrated in FIG. 2. Here, for convenience of description, the first reflective layer 160 illustrated in FIG. 2 is omitted in FIGS. 5A to 5G.

At least one of the second portion S2-2 of the second surface S2 of the refractive member 140A or the first area A1 of the base substrate 150A may have a 3-dimensional pattern. For example, the 3-dimensional pattern on the first area A1 of the base substrate 150A may have a semispherical shape as in the embodiment B1 illustrated in FIG. 5A, may have a circular shape as in the embodiment B3 illustrated in FIG. 5C, may have a conical or pyramidal shape as in the embodiment B5 illustrated in FIG. 5E, and may have at least one shape among a truncated conical shape, a truncated pyramidal shape, a reversed conical shape, and a reversed pyramidal shape as in the embodiment B7 illustrated in FIG. 5G.

Figure 5A:
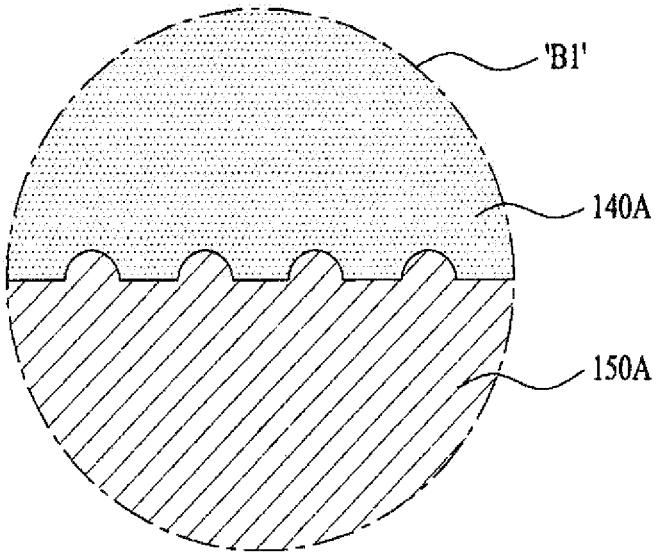
FIGS. 5A to 5G are enlarged partial sectional views of embodiments of portion "B" illustrated in FIG. 2.
Figure 5B:
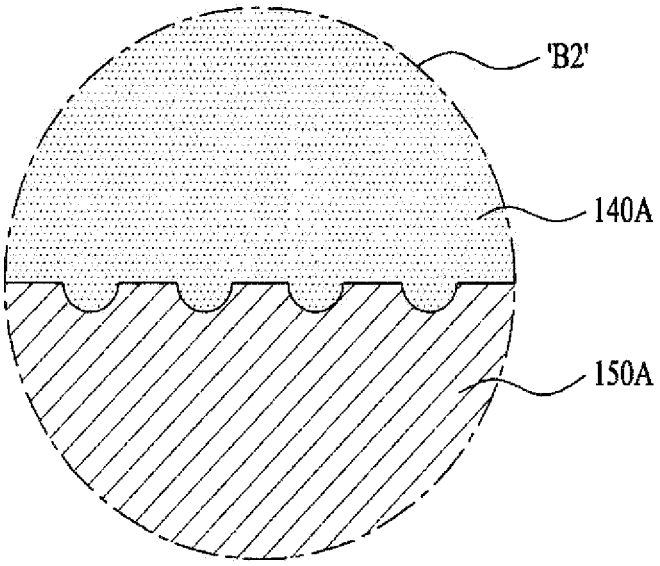
Figure 5C:
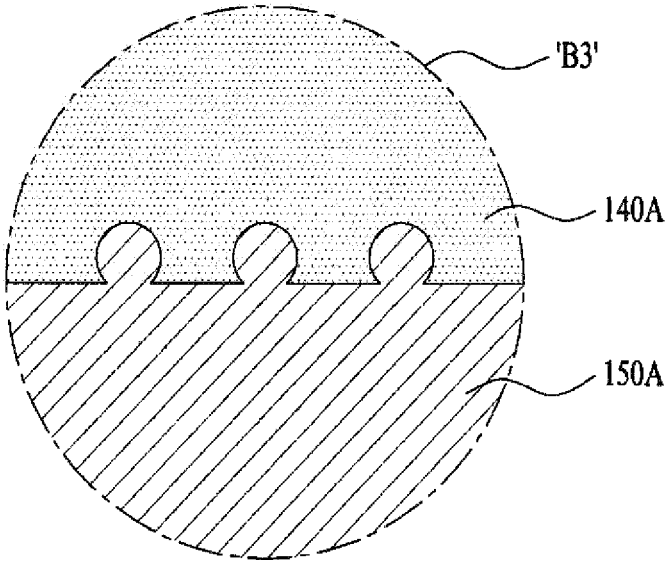
Figure 5D:
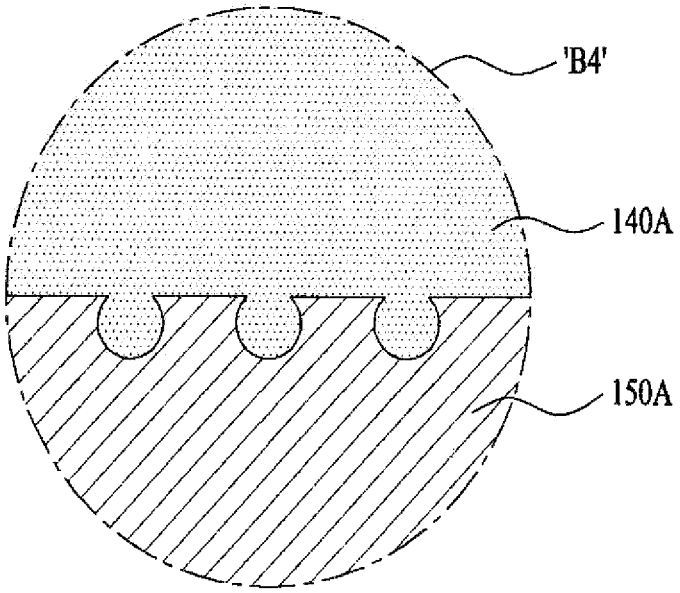
Figure 5E:
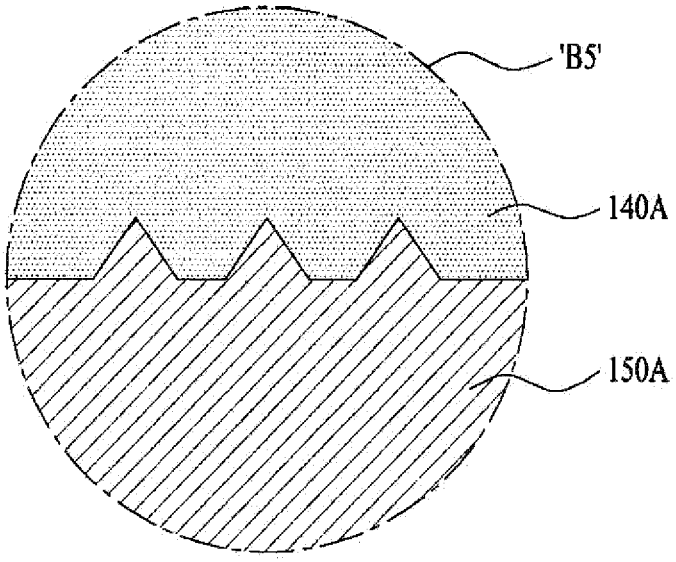
Figure 5F:
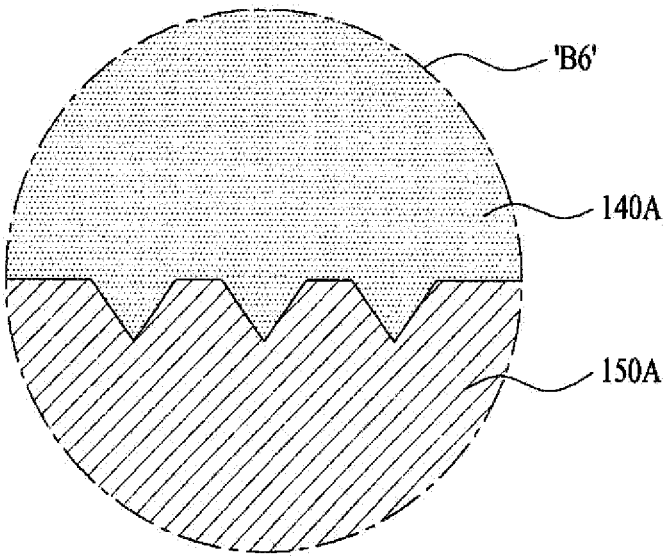
Figure 5G:
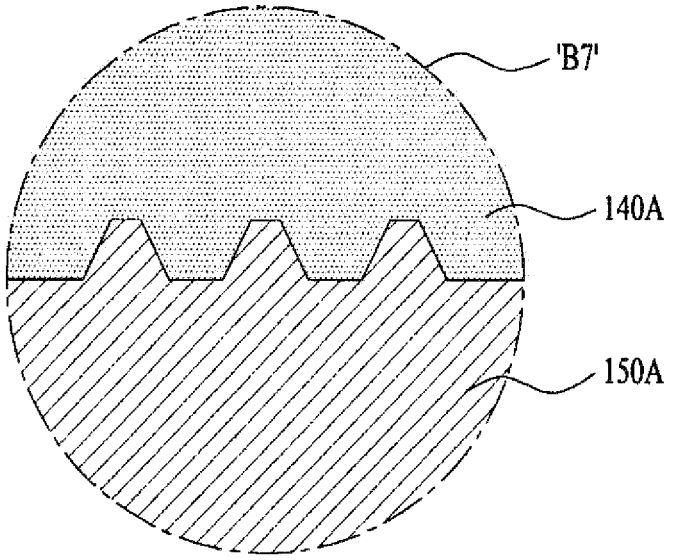

In addition, the 3-dimensional pattern on the second portion S2-2 of the second surface S2 of the refractive member 140A may have a semispherical shape as in the embodiment B2 illustrated in FIG. 5B, may have a circular shape as in the embodiment B4 illustrated in FIG. 5D, may have a conical or pyramidal shape as in the embodiment B6 illustrated in FIG. 5F, and may have at least one shape among a truncated conical shape, a truncated pyramidal shape, a reversed conical shape, and a reversed pyramidal shape as in the embodiment B7 illustrated in FIG. 5G.

FIGS. 6A to 6G are views to explain embodiments of a 2-dimensional pattern on the second portion S2-2 of the second surface S2 of the refractive member 140A or the upper surface of the first area A1 of the base substrate 150A, which faces the refractive member 140A.

In FIGS. 6A to 6G, reference numerals 220A to 220G may correspond to the second portion S2-2 of the refractive member 140A, or to the upper surface of the first area A1 of the base substrate 150A. In the case where the reference numerals 220A to 220G illustrated in FIGS. 6A to 6G correspond to the second portion S2-2 of the second surface S2, FIGS. 6A to 6G are bottom views illustrating the second portion S2-2 of the light-emitting apparatus 100A illustrated in FIG. 2 when viewed in the direction from the −Z-axis to the +Z-axis. On the other hand, in the case where the reference numerals 220A to 220G illustrated in FIGS. 6A to 6G correspond to the upper surface of the first area A1, FIGS. 6A to 6G are plan views illustrating the upper surface of the first area A1 of the light-emitting apparatus 100A illustrated in FIG. 2 when viewed in the direction from the +Z-axis to the −Z-axis.

Figure 6A:
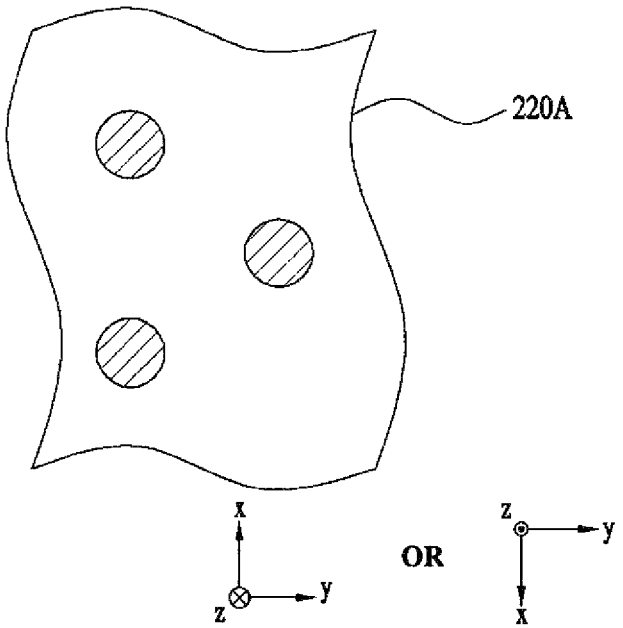
FIGS. 6A to 6G are views to, explain embodiments of a 2-dimensional pattern on the upper surface of a first area of a base substrate or a second portion of a second surface of a refractive member.
Figure 6B:
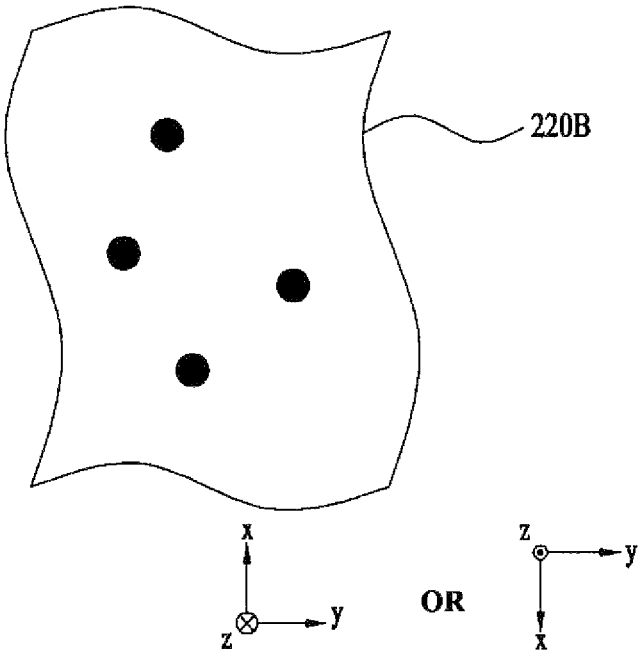
Figure 6C:
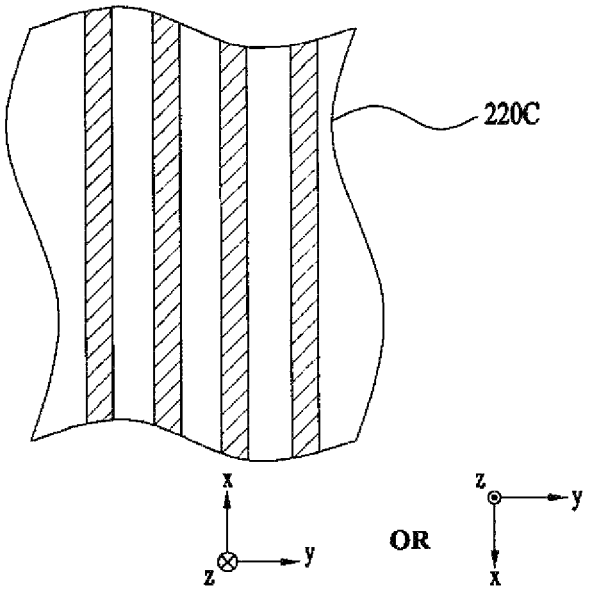
Figure 6D:
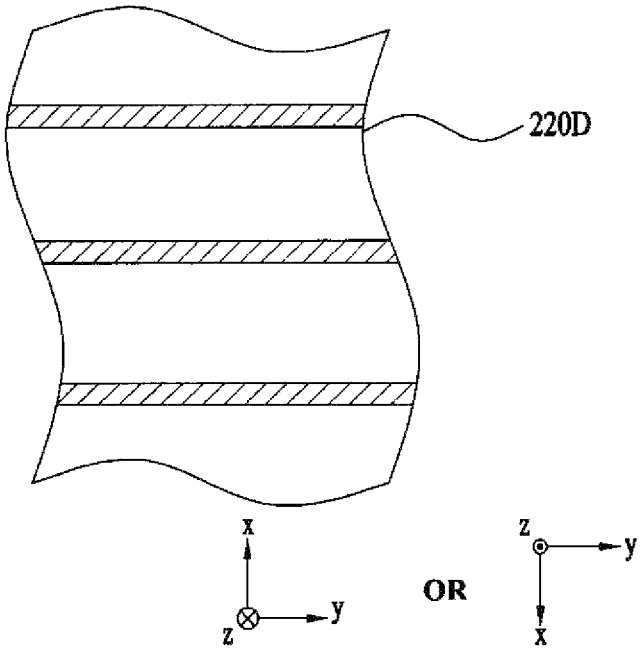
Figure 6E:
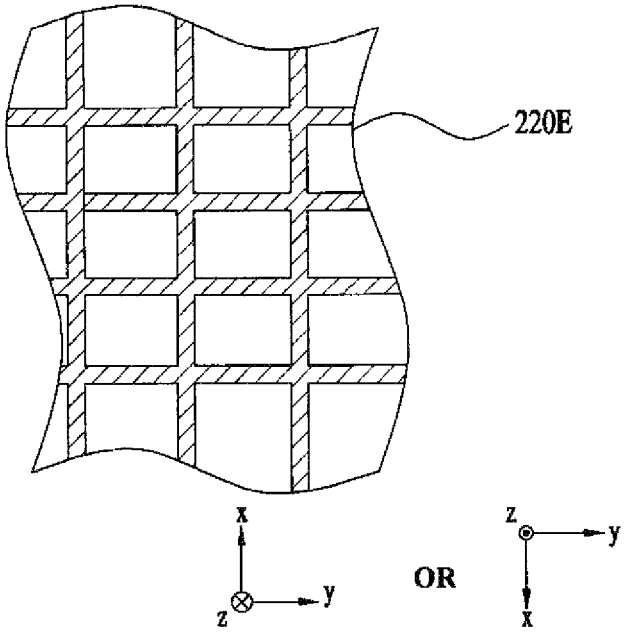
Figure 6F:
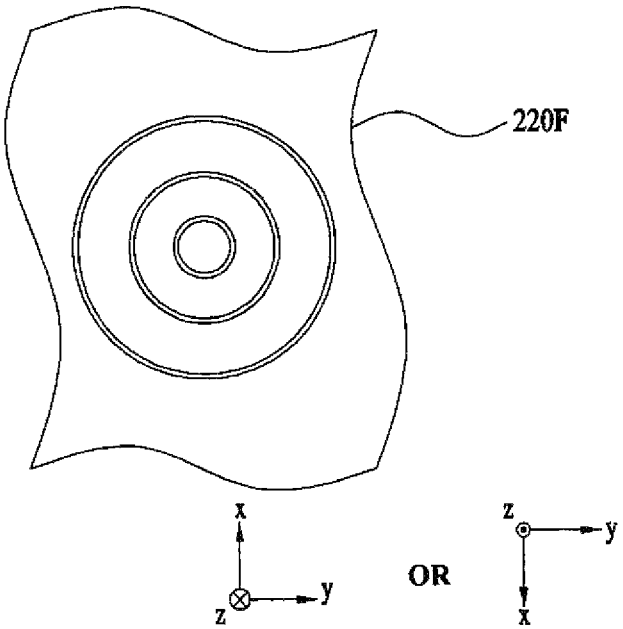
Figure 6G:
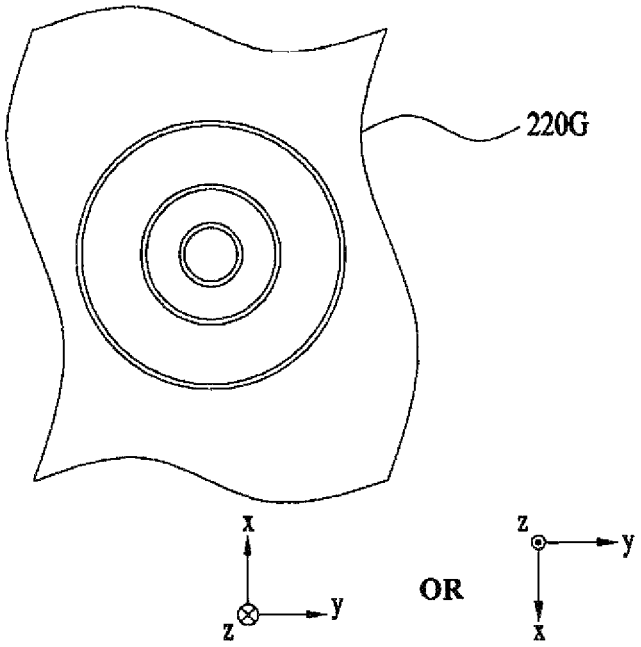

The 2-dimensional pattern on the second portion S2-2 of the second surface S2 of the refractive member 140A (or the upper surface of the first area A1 of the base substrate 150A) may have a circular shape as illustrated in FIG. 6A, may have a dot shape as illustrated in FIG. 6B, may have a vertical line shape as illustrated in FIG. 6C, may have a horizontal line shape as illustrated in FIG. 6D, may have a lattice shape as illustrated in FIG. 6E, or may have a ring shape as illustrated in FIGS. 6F and 6G. A plurality of rings illustrated in FIG. 6F is equidistantly arranged, and a plurality of rings illustrated in FIG. 6G is spaced apart from each other by different distances. For example, as exemplarily illustrated in FIG. 6G, the distances between the rings may gradually increase from the innermost ring to the outermost ring.

The 2-dimensional pattern may be made to have various shapes by adjusting several variables. For example, in the case of circles or dots illustrated in FIGS. 6A and 6B, the diameter of the circles or dots may correspond to a variable. In the case of vertical and horizontal lines and a lattice illustrated in FIGS. 6C, 6D and 6E, the width and length of the lines and the distances between the lines may correspond to variables. In the case of the rings illustrated in FIGS. 6F and 6G, the width of the lines, the diameter of the rings, and the distances between the rings may correspond to variables.

In another example, the second portion S2-2 of the second surface S2 of the refractive member 140A or the upper surface of the first area A1 of the base substrate 150A may simultaneously have any one of the 3-dimensional patterns as illustrated in FIGS. 5A to 5G as well as any one of the 2-dimensional patterns illustrated in FIGS. 6A to 6G.

As described above, when the first area A1 of the base substrate 150A or the second portion S2-2 of the second surface S2 of the refractive member 140A has at least one of the 2-dimensional pattern or the 3-dimensional pattern, the scattering of light becomes active at the interface between the second surface S2 of the refractive member 140A and the first area A1 of the base substrate 150A, which may allow a greater amount of light to be reflected by the reflector 130A and then be emitted through the third surface S3. Thereby, the light extraction efficiency of the light-emitting apparatus 100A may be improved.

Figure 7A:
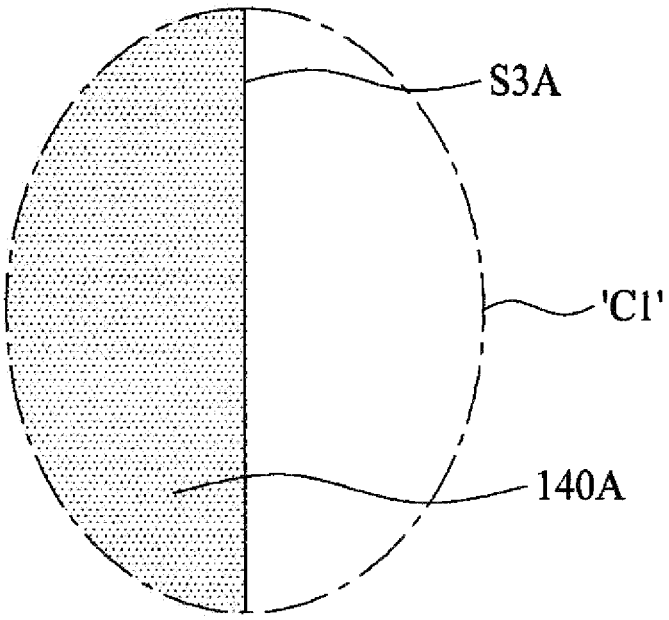
FIGS. 7A to 7D are enlarged partial sectional views of embodiments of portion "C" illustrated in FIG. 2.

FIGS. 7A to 70 are enlarged partial sectional views of embodiments C1 to C4 of portion "C" illustrated in FIG. 2.

The third surface S3 of the refractive member 140A may be a flat surface S3A as in the embodiment C1 illustrated in FIG. 7A.

Figure 7B:
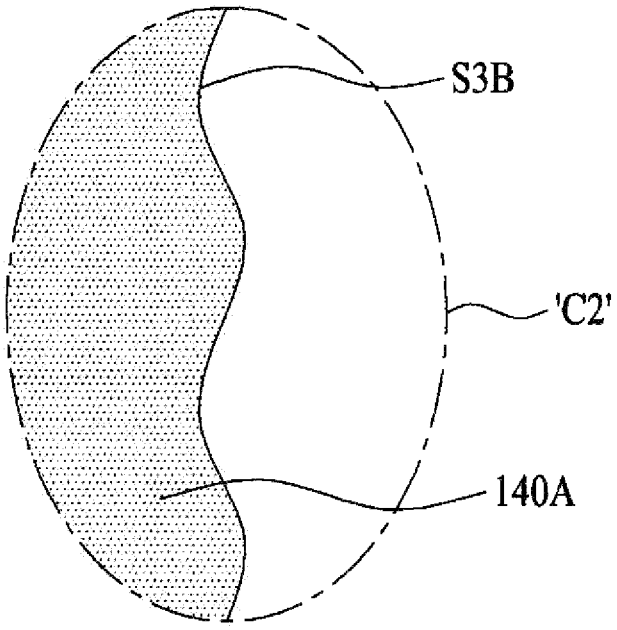

Alternatively, as in the embodiment C2 illustrated in FIG. 7B, the third surface S3 may include a curved surface S3B or a freeform curved surface S3B. In this case, the third surface S3B may have at least one inflection point.

Figure 7C:
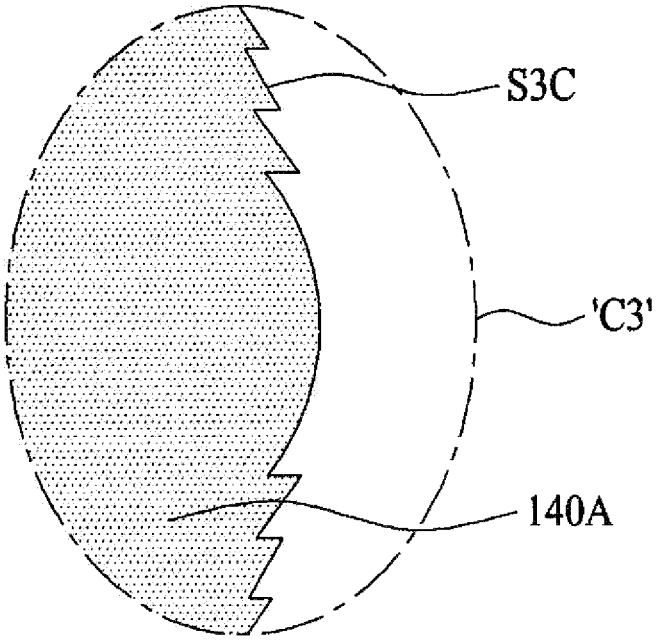

Alternatively, as in the embodiment C3 illustrated in FIG. 7C, the third surface S3 may include a Total Internal Reflective (TIR) surface S3C.

Alternatively, as in the embodiment C3 illustrated in FIG. 7C, a Fresnel lens S3C may be attached to the third surface S3. The Fresnel lens S3C attached to the third surface S3 serves to transmit light reflected by the reflector 130A.

Figure 7D:
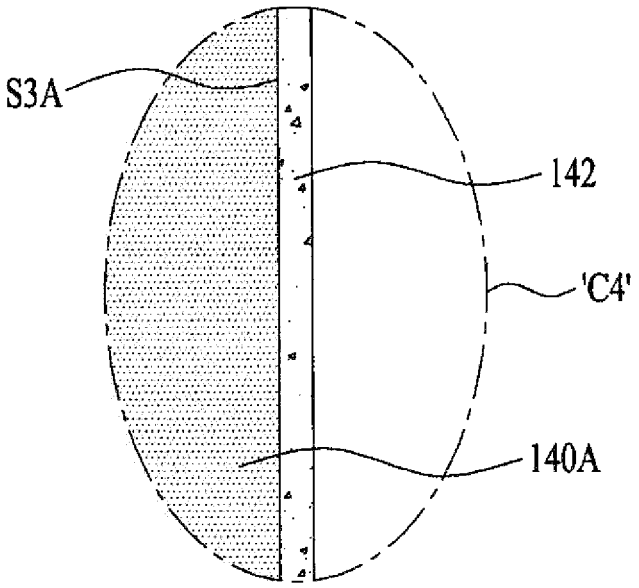

Alternatively, as in the embodiment C4 illustrated in FIG. 7D, an anti-reflective film 142 may be additionally disposed on the flat third surface S3 of the refractive member 140A.

Alternatively, the third surface S3 may simultaneously include at least two of the various embodiments illustrated in FIG. 7A, 7B, 7C, or 7D.

As described above, when the third surface S3 of the refractive member 140A has various shapes, the light, reflected by the reflector 130A and introduced into the third surface S3, may be emitted in a greater amount through the third surface S3.

In addition, the first reflective layer 160 may further be disposed between at least a part of the second portion S2-2 of the refractive member 140A and the first area A1 of the base substrate 150A. Although the first reflective layer 160 may take the form of a film or a coating attached to the second portion S2-2 of the refractive member 140A or the first area A1 of the base substrate 150A, the embodiment is not limited as to the manner in which the first reflective layer 160 is disposed.

In the case where the first reflective layer 160 is provided, light present inside the refractive member 140A may be directed to the reflector 130A after being reflected by the first reflective layer 160. As such, a greater amount of light may be emitted through the third surface S3. That is, the light extraction efficiency of the light-emitting apparatus 100A may be improved.

When the reflector 130A or the first reflective layer 160 has a reflectance below 60%, reflection cannot be properly performed. Thus, although the reflectance of the reflector 130A or the first reflective layer 160 may be within a range from 60% to 100%, the embodiment is not limited thereto. In some cases, the first reflective layer 160 may be omitted.

In addition, referring again to FIGS. 2 and 3, the first adhesive part 170 may be disposed between the first portion S2-1 of the second surface S2 of the refractive member 140A and the wavelength converter 120. At this time, the first adhesive part 170 may comprise at least one of sintered or fired polymer, $Al_2O_3$, or $SiO_2$. As such, although the first portion S2-1 of the second surface S2 of the refractive, member 140A and the wavelength converter 120 may be bonded to each other via the first adhesive part 170, the embodiment is not limited thereto.

For example, when the refractive member 140A and the wavelength converter 120 are fabricated separately, the refractive member 140A and the wavelength converter 120 may be bonded to each other via various methods.

In one example, when powder such as, for example, $Al_2O_3$ or $SiO_2$ glass, or polymer, such as silicon, is applied evenly and thinly to the bonding region of the wavelength converter 120 and the refractive member 140A, and the wavelength converter 120 and the refractive member 140A are subjected to sintering or firing, the two 120 and 140A may be bonded to each other. At this time, the first adhesive part 170 may be present between the two 120 and 140A.

Alternatively, although not illustrated, a second adhesive part may be disposed between the second portion S2-2 of the second surface S2 of the refractive member 140A and the first area A1 of the base substrate 150A, so as to attach the two S2-2 and A1 to each other. In addition, the first reflective layer 160 may serve as the second adhesive part. As such, as the refractive member 140A is bonded to the base substrate 150A, rather than being directly bonded to the wavelength converter 120, the wavelength converter 120 may be indirectly bonded to the refractive member 140A.

In addition, after one of the refractive member 140A and the wavelength converter 120 is first fabricated, the one that is fabricated first may be used as a substrate for the other one to be subsequently fabricated. For example, when the refractive member 140A is fabricated first, the flat surface of the refractive member 140A that is fabricate first may be used as a substrate, such that the wavelength converter 120 may be fabricated on the substrate.

Alternatively, a jig may be used to fabricate the wavelength converter 120 and the refractive member 140A at the same time.

Figure 8:
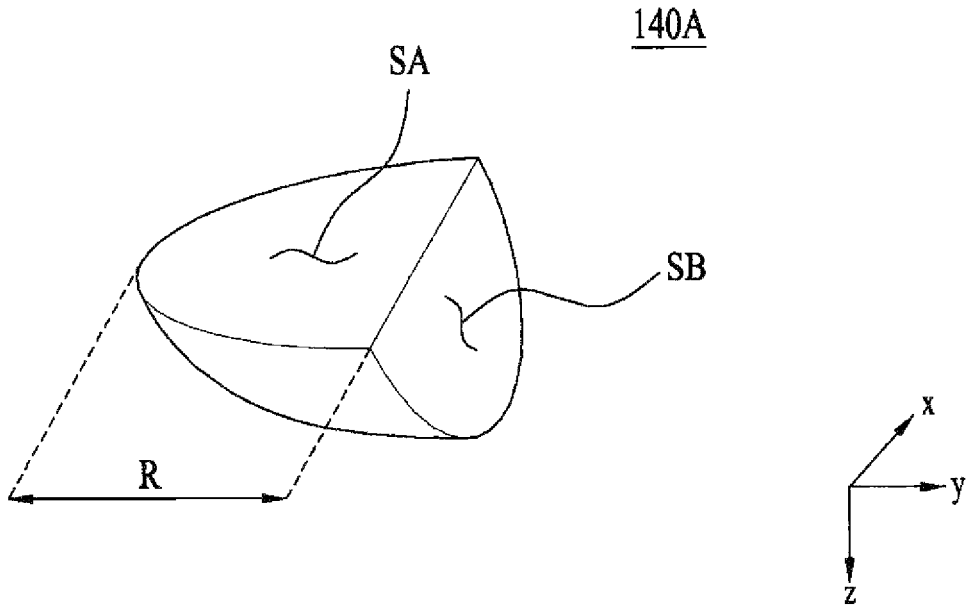
FIG. 8 is a perspective view of the refractive member illustrated in FIGS. 1 to 3.

FIG. 8 is a perspective view of the refractive member 140A illustrated in FIGS. 1 to 3.

Although the size of the refractive member 140A may be changed based on the performance of the entire light-emitting apparatus 100A, the size of the entire light-emitting apparatus 100A may be changed based on the size of the refractive member 140A. When it is possible to reduce the overall size of the light-emitting apparatus 100A, the freedom in the design of a headlamp for a vehicle or a flashlight including the light-emitting apparatus 100A may increase. In addition, such a reduction in size may increase portability or ease in handling.

Referring to FIGS. 3 to 8 in consideration thereof, the diameter R of the second surface S2 of the refractive member 140A may be within a range from 10 mm to 100 mm. In addition, the ratio RAT of the area FWHMA of the FWHM of the light, the wavelength of which has been converted by the wavelength converter 120, to the area SA of the second surface S2 or the area SB of the third surface S3 of the refractive member 140A may be represented by the following Equation 1 or 2.

$$RAT = \frac{FWHMA}{SA} \quad \text{Equation 1}$$

$$RAT = \frac{FWHMA}{SB} \quad \text{Equation 2}$$

When the ratio RAT is below 0.001, the light having the wavelength converted by the wavelength converter 120 may not be used as lighting. In addition, when the ratio RAT exceeds 1, most light spreads widely to thereby be emitted from the light-emitting apparatus 100A. Thus, although the ratio RAT may be within a range from 0.001 to 1 according to the application, the embodiment is not limited thereto.

Figure 9:
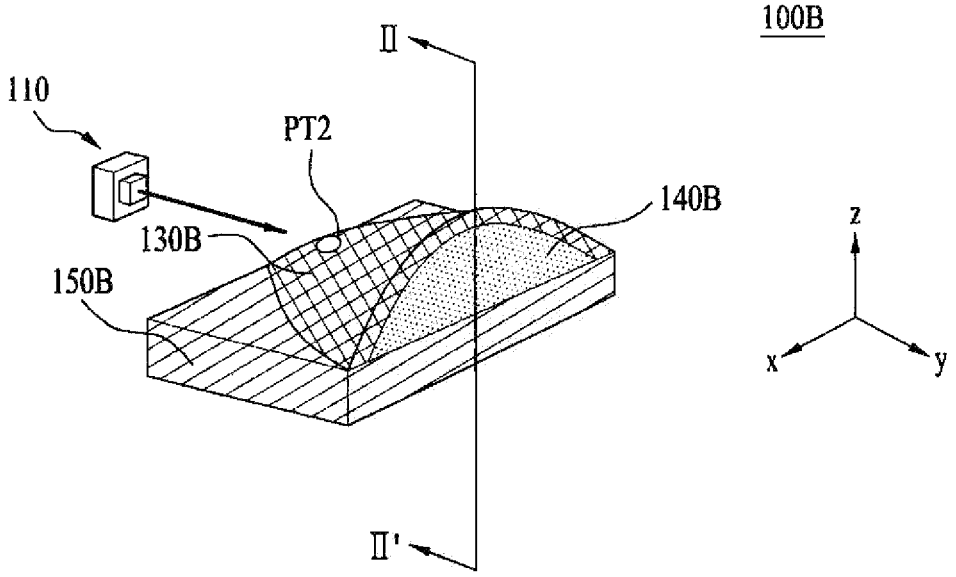
FIG. 9 is a perspective view of a light-emitting apparatus according to another embodiment.
Figure 10:
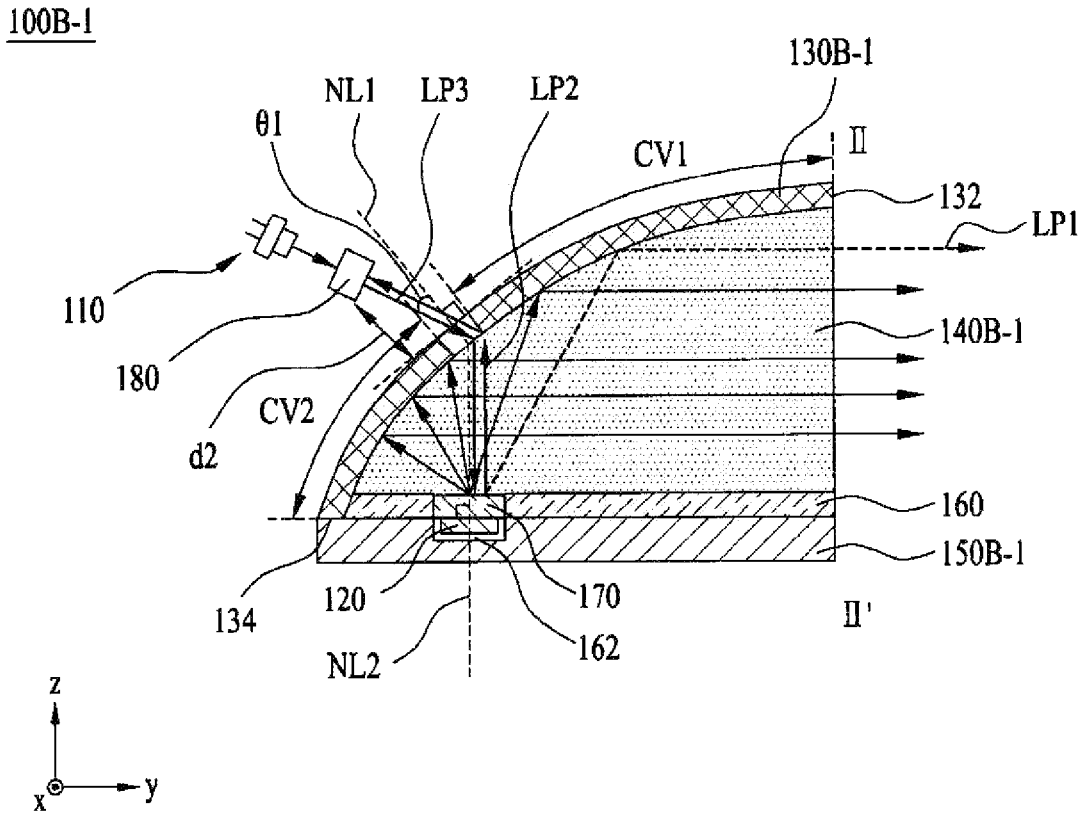
FIG. 10 is a sectional view of one embodiment taken along line II-II of the light-emitting apparatus illustrated in FIG. 9.
Figure 11:
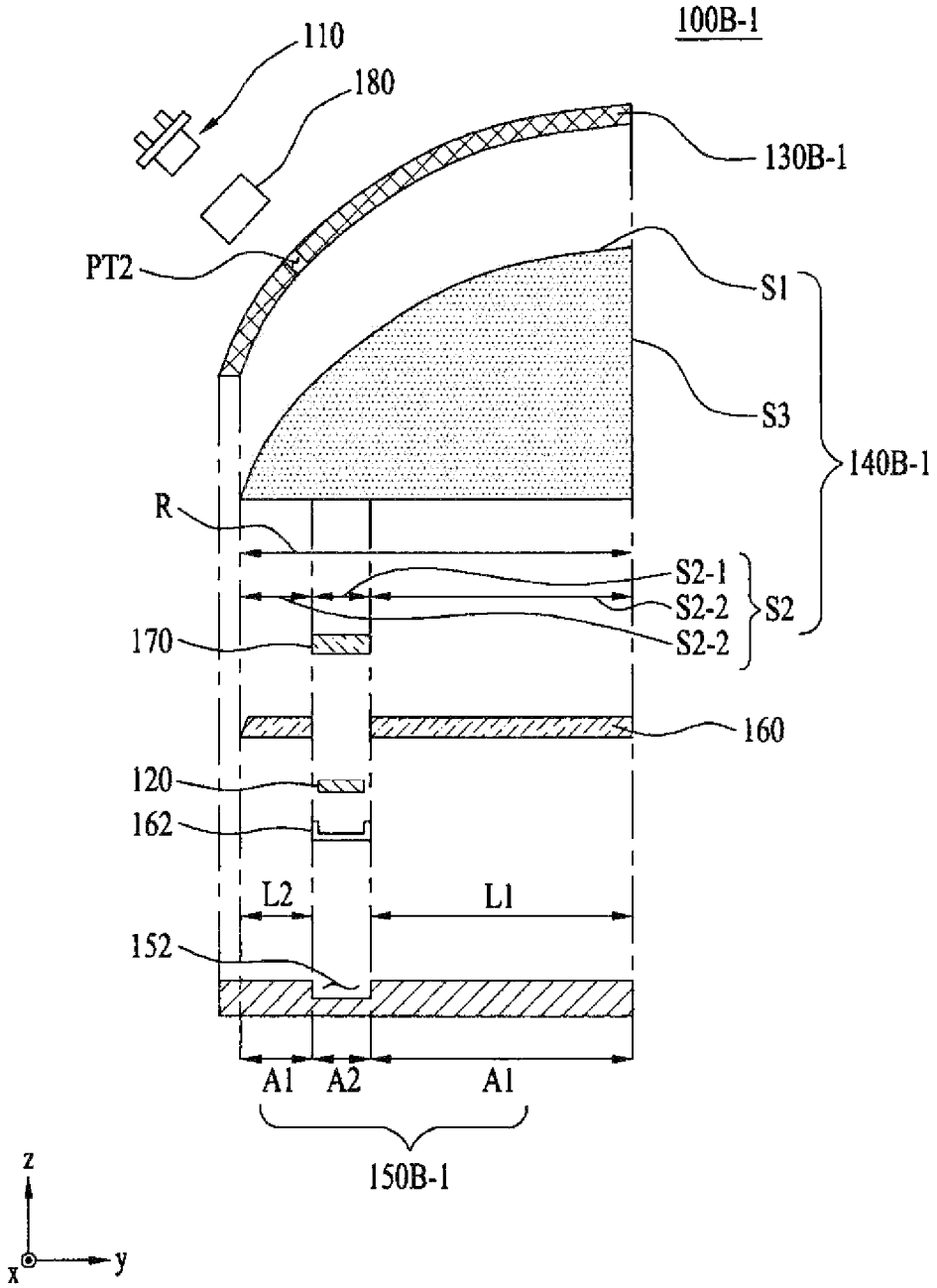
FIG. 11 is an exploded sectional view of the light-emitting apparatus illustrated in FIG. 10.
Figure 12:
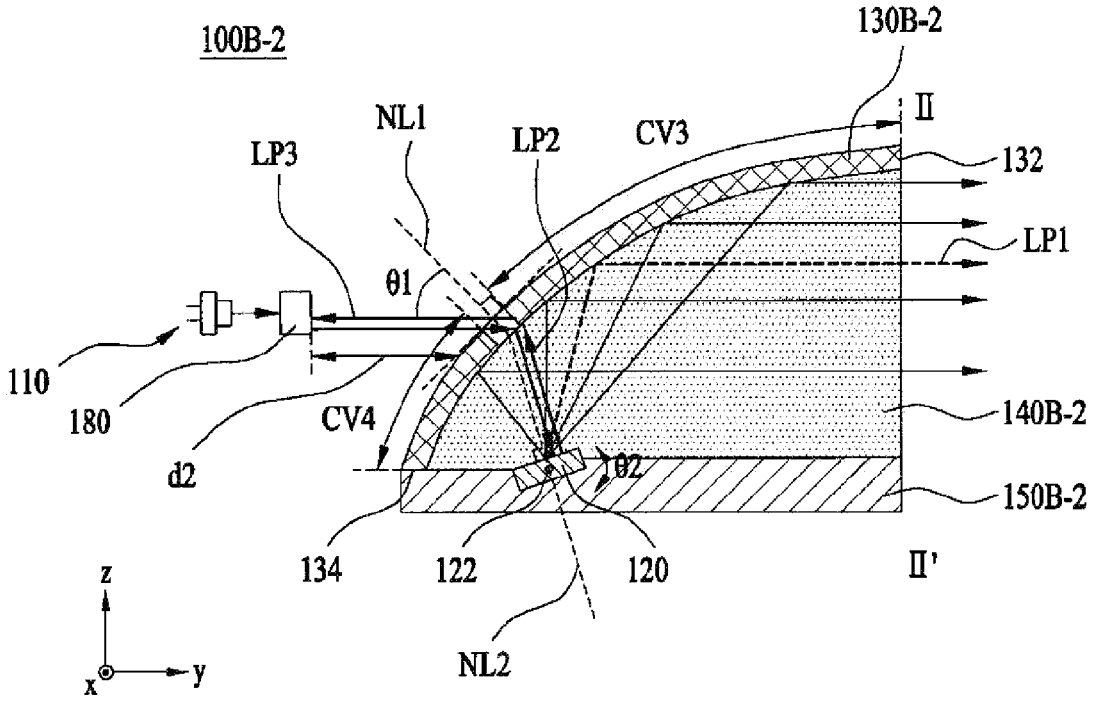
FIG. 12 is a sectional view of another embodiment taken along line II-II of the light-emitting apparatus illustrated in FIG. 9.

FIG. 9 is a perspective view of the light-emitting apparatus 100B according to another embodiment, FIG. 10 is a sectional view of one embodiment 100B-1 taken along line II-II' of the light-emitting apparatus 100B illustrated in FIG. 9, FIG. 11 is an exploded sectional view of the light-emitting apparatus 100B-1 illustrated in FIG. 10, and FIG. 12 is a sectional view of another embodiment 100B-2 taken along line II-II' of the light-emitting apparatus 100B illustrated in FIG. 9.

For convenience of description, the light transmitting layer 180 illustrated in FIGS. 10 and 11 is omitted in FIG. 9. In addition, the reference numeral 130B illustrated in FIG. 9 corresponds to 130B-1 or 130B-2 illustrated in FIGS. 10 to 12, the reference numeral 140B corresponds to 140B-1 or 140B-2 illustrated in FIGS. 10 to 12, and the reference numeral 150B corresponds to 150B-1 or 150B-2 illustrated in FIGS. 10 to 12.

Each of the light-emitting apparatuses 100B, 100B-1 and 100B-2 according to the different embodiments may include the light source 110, the wavelength converter 120, a reflector 130B, 130B-1 or 130B-2, a refractive member 140B, 140B-1 or 140B-2, a substrate 150B, 150B-1 or 150B-2, first and second reflective layers 160 and 162, the first adhesive part 170, and the light transmitting layer 180.

The light source 110, the wavelength converter 120, the refractive member 140B, 140B-1 or 140B-2, the first reflective layer 160, the first adhesive part 170, and the light transmitting layer 180 illustrated in FIGS. 9 to 12 respectively correspond to the light source 110, the wavelength converter 120, the refractive member 140A, the first reflective layer 160, the first adhesive part 170, and the light transmitting layer 180 illustrated in FIGS. 1 to 3, and thus a repeated description thereof will be omitted below.

Accordingly, of course, the difference in the index of refraction between the wavelength converter 120 and the refractive member 140B, 140B-1 or 140B-2, the shape of the second portion S2-2 of the second surface S2 of the refractive member 140A or the 3-dimensional pattern and the 2-dimensional pattern on the first area A1 of the base substrate 150A illustrated in FIGS. 5A to 5G and FIGS. 6A to 6G, and the shape of the third surface S3 of the refractive member 140A illustrated in FIGS. 7A to 7D may be applied to the light-emitting apparatuses 100B, 100B-1 and 100B-2 illustrated in FIGS. 9 to 12. In addition, unless otherwise described in the light-emitting apparatuses 100B, 100B-1 and 100B-2 illustrated in FIGS. 9 to 12, the above-described features of the light-emitting apparatus 100A illustrated in FIGS. 1 to 3 may of course be applied to the light-emitting apparatuses 100B, 100B-1 and 100B-2 illustrated in FIGS. 9 to 12.

However, in the case of the light-emitting apparatus 100A illustrated in FIGS. 1 to 3, the light transmitting layer 180 is disposed between the light source 110 and the first through-hole PT1, i.e. between the light source 110 and the wavelength converter 120. On the other hand, in the case of the light-emitting apparatuses 100B, 100B-1 and 100B-2 illustrated in FIGS. 9 to 12, the light transmitting layer 180 is disposed between the light source 110 and the second through-hole PT2, i.e. between the light source 110 and the reflector 130B-1 or 130B-2. The light transmitting layer 180 illustrated in FIGS. 9 to 12 has the same role as the light transmitting layer 180 illustrated in FIGS. 1 to 3 except for the difference in the installation position thereof.

In addition, the light source 110 may be spaced apart from the reflector 130B, 130B-1 or 130B-2 by the second distance d2. Here, although the second distance d2 may be 10 μm or more, the embodiment is not limited thereto.

Meanwhile, unlike the reflector 130A of the light-emitting apparatus 100A illustrated in FIGS. 1 to 3, the reflector 130B, 130B-1 or 130B-2 illustrated in FIGS. 9 to 12 includes a second through-hole PT2. The second through-hole PT2 corresponds to an inlet into which the light emitted from the light source 110 is introduced. For the same reason that the first through-hole PT1 is located closer to the first surface S1 of the refractive member 140A than the third surface S3, the second through-hole PT2 is also located closer to the base substrate 150B-1 or 150B-2 than the third surface S3. That is, the first distance CV1 or CV3 from the second through-hole PT2 to the end 132 of the reflector 130B-1 or 130B-2 that comes into contact with the third surface S3 of the refractive member 140B-1 or 140B-2 may be greater than the second distance CV2 or CV4 from the second through-hole PT2 to the other end 134 of the reflector 130B-1 or 130B-2 that comes into contact with the base substrate 150B-1 or 150B-2.

Like the first through-hole PT1, although laser diodes having a narrower viewing angle than light-emitting diodes may be advantageous in order to introduce light into the second through-hole PT2, the embodiment is not limited thereto. That is, when an optical system (not illustrated) capable of reducing the viewing angle is located between the light source 110, i.e. the light-emitting diodes and the second through-hole PT2, it is possible to reduce the viewing angle of light emitted from the light-emitting diodes to enable the easy introduction of light into the second through-hole PT2.

In addition, the base substrate 150A of the light-emitting apparatus 100A illustrated in FIGS. 1 to 3 has the first through-hole PT1, whereas the base substrate 150B-1 of the light-emitting apparatus 100B or 100B-1 includes a recess 152 instead of the first through-hole PT1.

The recess 152 is formed in the second area A2 of the base substrate 150B-1, and the wavelength converter 120 is located in the recess 152.

In addition, the second reflective layer 162 may be disposed in the recess 152 between the wavelength converter 120 and the base substrate 150B-1. The light, which is introduced into the wavelength converter 120 by way of the refractive member 140B-1 through the second through-hole PT2, may pass through the wavelength converter 120 so as to be absorbed by the base substrate 150B-1, or may be emitted through the bottom surface of the base substrate 150B-1. To prevent this, the second reflective layer 162 is disposed. The second reflective layer 162 reflects the light having passed through the wavelength converter 120 so as to direct the light to the refractive member 140B-1. Thereby, the light extraction efficiency of the light-emitting apparatus 100B or 100B-1 may be improved. The second reflective layer 162 may take the form of a film, or a coating attached to the wavelength converter 120 or the base substrate 150B-1.

When the reflectance of the second reflective layer 162 is below 60%, the second reflective layer 162 cannot properly perform reflection. Thus, although the reflectance of the second reflective layer 162 may be within a range from 60% to 100%, the embodiment is not limited thereto.

In some cases, the second reflective layer 162 may be omitted.

Meanwhile, referring to FIG. 12, the wavelength converter 120 may be disposed on the base substrate 150B-2 so as to be rotatable at the position facing the second through-hole PT2. As the second through-hole PT2 is located closer to the other end 134 than the end 132 of the reflector 130B, 130B-1 or 130B-2, the first-first distance CV3 illustrated in FIG. 12 becomes greater than the first-first distance CV1 illustrated in FIG. 10. That is, the second-second distance CV4 illustrated in FIG. 12 becomes smaller than the first-second distance CV2 illustrated in FIG. 10. In this case, it may be difficult for the light introduced into the second through-hole PT2 to reach the wavelength converter 120 after passing through the refractive member 140B-1. To solve this problem, as exemplarily illustrated in FIG. 12, the wavelength converter 120 may be rotatable with a rotating shaft 122 as the center at a position facing the second through-hole PT2.

Referring to FIGS. 10 and 12, when the light introduced through the second through-hole PT2 is refracted in the refractive member 140B-1 or 140B-2 and is emitted from the third surface S3 of the refractive member 140B-1 or 140B-2 in the direction designated by the arrow LP1 in the state in which the wavelength of the light is not converted in the wavelength converter 120, the light may have an effect on color distribution and may have a harmful effect on the human body.

In the case where the light, the wavelength of which is not converted in the wavelength converter 120, is reflected by the reflector 130B-1 or 130B-2 to thereby be output, assuming that the numerical value of the Maximum Permissible Exposure (MPE) of the output light is 0.00255 $W/m^2$ or less and the exposure time of the light to the human body is 0.25 seconds or less, the light has no harmful effect on the human body. Here, "MPE" means the maximum intensity of laser beam output that does not cause any damage to the human, body.

However, when the numerical value of the MPE is greater than 0.00255 $W/m^2$ and the exposure time becomes greater than 0.25 seconds, the light may cause biological damage to the human body including the eyes and the skin. Therefore, to prevent this problem, it is necessary to return the light, the wavelength of which is not converted in the wavelength converter 120, to the light source 110 through the second through-hole PT'2 in the direction designated by the arrow LP3 after the light travels in the direction designated by the arrow LP2 through the inner surface of the refractive member 140B-1 or 140B-2.

That is, the light, the wavelength of which is not converted in the wavelength converter 120, needs to travel in the direction designated by the arrow LP2, which is parallel to the second normal NL2 of the wavelength converter 120, within the refractive member 140B-1 or 140B-2. In addition, the light, which is introduced through the second through-hole PT2 and refracted in the refractive member 140B-1 or 140B-2 so as to be directed to the wavelength converter 120, needs to travel in the direction parallel to the second normal NL2 of the wavelength converter 120. To this end, at least one of the incident angle θ1 of the light into the second through-hole PT2, illustrated in FIGS. 10 and 12, or the rotation angle θ2 of the wavelength converter 120, illustrated in FIG. 12, may be adjusted.

Here, the incident angle θ1 means the angle between the traveling path of the light emitted from the light source 110 and the first normal NL1 at the point of the reflector 130B-1 or 130B-2 where the second through-hole PT2 is present.

When the difference between the first distance CV1 or CV3 and the second distance CV2 or CV4 is not great, it may not be necessary to adjust the incident angle θ1 or the rotation angle θ2.

When the difference between the first distance CV1 or CV3 and the second distance CV2 or CV4 increases, it may be possible to cause the light to travel in a direction parallel to the second normal NL2 in the refractive member 140B-1 or 140B-2 by adjusting only one of the incident angle θ1 or the rotation angle θ2.

When the difference between the first distance CV1 or CV3 and the second distance CV2 or CV4 increases further, it may be possible to cause the light to travel in a direction parallel to the second normal NL2 in the refractive member 140B-1 or 140B-2 by adjusting both the incident angle θ1 and the rotation angle θ2.

As described above, according to the position of the reflector 130B, 130B-1 or 130B-2 at which the second through-hole PT2 is formed, i.e. according to the position of the reflector 130B, 130B-1 or 130B-2 into which the light is introduced, at least one of the incident angle θ1 or the rotation angle θ2 may be adjusted.

Figure 13:
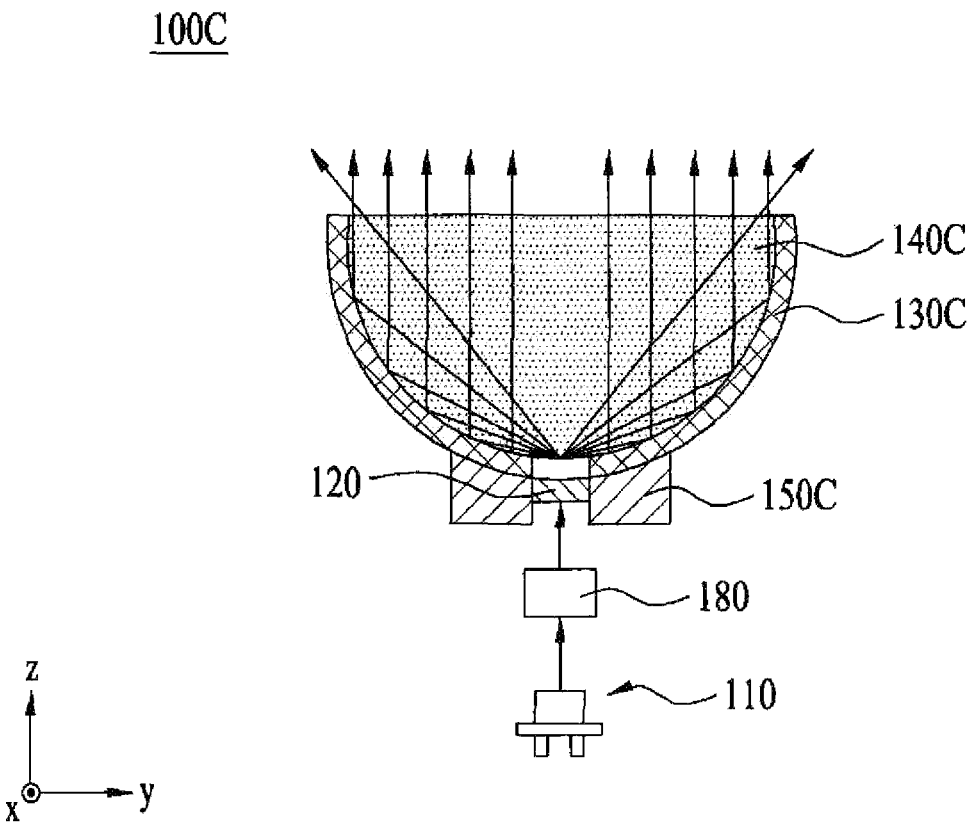
FIG. 13 is a sectional view of a light-emitting apparatus according to another embodiment.
Figure 14:
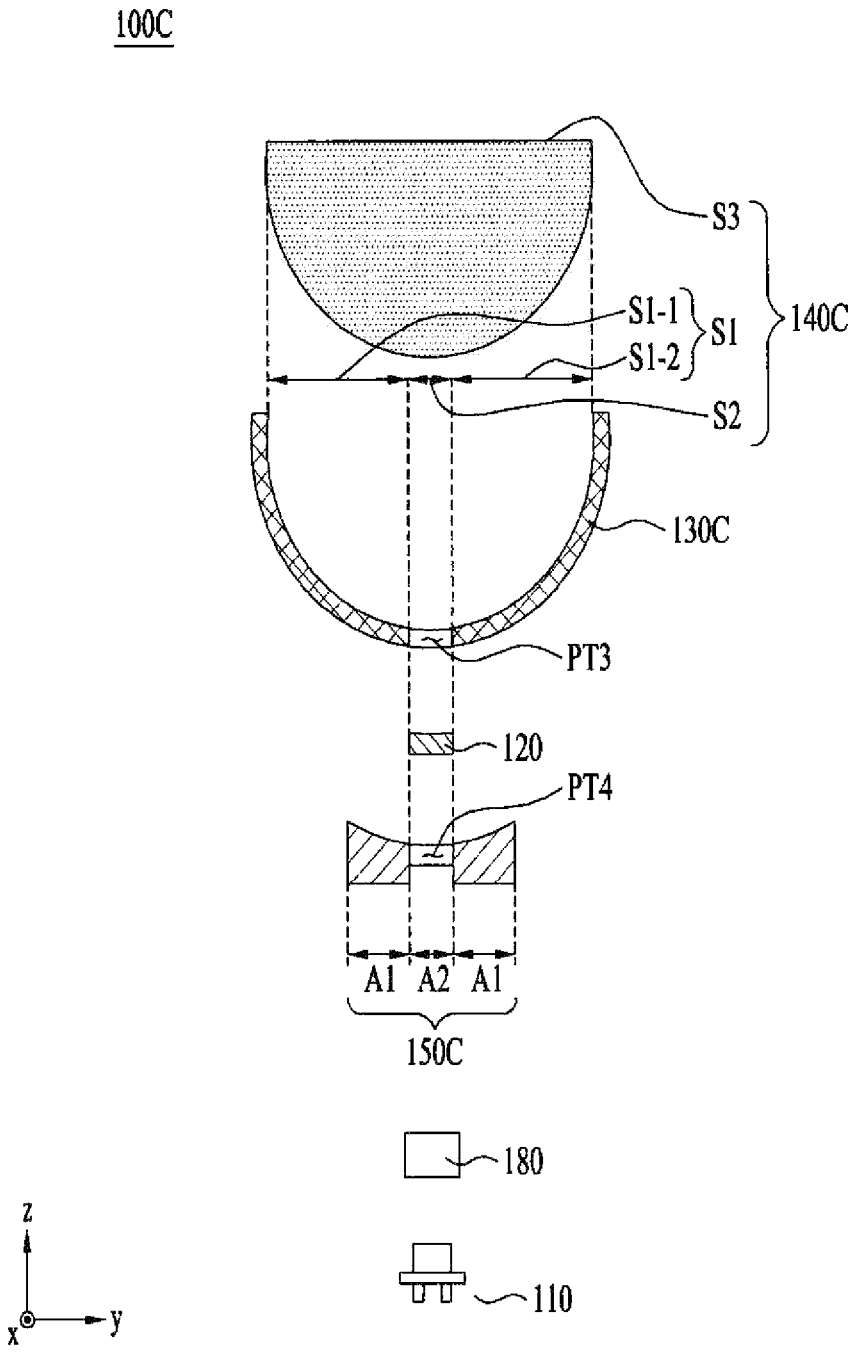
FIG. 14 is an exploded sectional view of the light-emitting apparatus illustrated in FIG. 13.

FIG. 13 is a sectional view of the light-emitting apparatus 100C according to another embodiment, and FIG. 14 is an exploded sectional view of the light-emitting apparatus 100C illustrated in FIG. 13.

The light-emitting apparatus 100C of the present embodiment may include the light source 110, the wavelength converter 120, a reflector 130C, a refractive member 140C, a substrate 150C, and the light transmitting layer 180.

The light source 110, the wavelength converter 120, the reflector 130C, the refractive member 140C, the substrate 150C, and the light transmitting layer 180 illustrated in FIGS. 13 and 14 respectively perform the same functions as the light source 110, the wavelength converter 120, the reflector 130A, 130B-1 or 130B-2, the refractive member 140A, 140B-1 or 140B-2, the substrate 150A, 150B-1 or 150B-2, and the light transmitting layer 180 illustrated in FIGS. 1 to 3 and FIGS. 9 to 12. Thus, unless otherwise described in the light-emitting apparatus 100C illustrated in FIGS. 13 and 14, the above-described features of the light-emitting apparatus 100A illustrated in FIGS. 1 to 3 and the light-emitting apparatus 100B, 100B-1 or 100B-2 illustrated in FIGS. 9 to 12 may of course be applied to the light-emitting apparatus 100C illustrated in FIGS. 13 and 14.

The relative arrangement of the reflector 130C, the refractive member 140C, and the substrate 150C differs from that in the light-emitting apparatus 100A, illustrated in FIGS. 1 to 3, and the light-emitting apparatus 100B, 100B-1 or 100B-2 illustrated in FIGS. 9 to 12. This will be described as follows.

In the case of the light-emitting apparatuses 100A, 100B 100B-1 and 100B-2 illustrated in FIGS. 1 to 3 and FIGS. 9 to 12, the base substrate 150A, 150B-1 or 150B-2 is opposite to the reflector 130A, 130B-1 or 130B-2 with the refractive member 140A, 140B-1 or 140B-2 interposed therebetween. On the other hand, in the case of the light-emitting apparatus 100C illustrated in FIGS. 13 and 14, the base substrate 150C is disposed to be opposite to the refractive member 140C with the reflector 130C interposed therebetween.

In addition, unlike the refractive members 140A, 140B-1 and 140B-2 illustrated in FIGS. 1 to 3 and FIGS. 9 to 12, the second surface S2 of the refractive member 140C includes only a portion corresponding to the first portion S2-1 of the second surface S2 of the refractive member 140A, 140B-1 or 140B-2, and does not include a portion corresponding to the second portion S2-2 of the second surface S2.

In addition, the first surface S1 of the refractive member 140C has a cross-sectional shape including first and second portions S1-1 and S1-2 which are located on the left and right sides of the second surface S2 and face the reflector 130C. For example, the first and second portions S1-1 and S1-2 of the first surface S1 may have bilaterally symmetrical cross-sectional shapes with the second surface S2 as the center.

In addition, unlike the light-emitting apparatus 100A illustrated in FIGS. 1 to 3 or the light-emitting apparatuses 100B, 100B-1 and 100B-2 illustrated in FIGS. 9 to 12, in the case of the light-emitting apparatus 100C illustrated in FIGS. 13 and 14, the base substrate 150C is located below the third surface S3 of the refractive member 140C.

In addition, the first surface S1 and the second surface S2 of the refractive member 140C may have a parabolic shape.

The reflector 130C is formed with a third through-hole PT3 in the same manner as the light-emitting apparatuses 100B, 100B-1 and 100B-2 illustrated in FIGS. 9 to 12, the wavelength converter 120 is located in a fourth through-hole PT4 formed in the base substrate 150C in the same manner as the light-emitting apparatus 100A illustrated in FIGS. 1 to 3, and light is introduced into the refractive member 140C after passing through the wavelength converter 120 in the same manner as the light-emitting apparatus 100A illustrated in FIGS. 1 to 3.

Hence, the description of the light-emitting apparatuses 100A, 100B, 100B-1 and 100B-2 illustrated in FIGS. 1 to 3 and FIGS. 9 to 12 may be applied to the light-emitting apparatus 100C illustrated in FIGS. 13 and 14.

Although not illustrated in FIGS. 13 and 14, as exemplarily illustrated in FIGS. 1 to 3 and FIGS. 9 to 12, the second reflective layer (not illustrated) may be disposed between the reflector 130C and the first and second portions S1-1 and S1-2 of the first surface S1 of the refractive member 140C. In addition, as exemplarily illustrated in FIG. 11, the first adhesive part (not illustrated) may be located between the wavelength converter 120 and the refractive member 140C.

In addition, the above description related to the difference in the index of refraction between the wavelength converter 120 and the refractive member 140A may be applied to the difference in the index of refraction between the wavelength converter 120 and the refractive member 140C. In addition, the shape of the pattern on the second-second portion S2-2 of the second surface S2 of the refractive member 140A or the shape of the pattern on the first area A1 of the base substrate 150A illustrated in FIGS. 5A to 5G and FIGS. 6A to 6G may be applied to the shape of the first surface S1 of the refractive member 140C or the first area A1 of the base substrate 150C. In addition, the shape of the third surface S3 of the refractive member 140A illustrated in FIGS. 7A to 7D may of course be applied to the third surface S3 of the refractive member 140C illustrated in FIGS. 13 and 14.

When the light-emitting apparatuses 100A to 100C described above are used for a lighting apparatus for a vehicle, a plurality of light sources 110 may be provided. As such, the number of light sources 110 that is provided may be changed according to the applications of the light-emitting apparatuses 100A to 100C of the embodiments.

Hereinafter, light-emitting apparatuses 100D to 100G according to other embodiments, which include the light sources 110 and various optical devices, will be described with reference to the accompanying drawings. For convenience of description, although three light sources 110 will be described, two light sources 110 may be provided, or four or more light sources 110 may be provided.

FIGS. 15 to 18 are sectional views of the light-emitting apparatuses 100D to 100G according to other embodiments.

Figure 15:
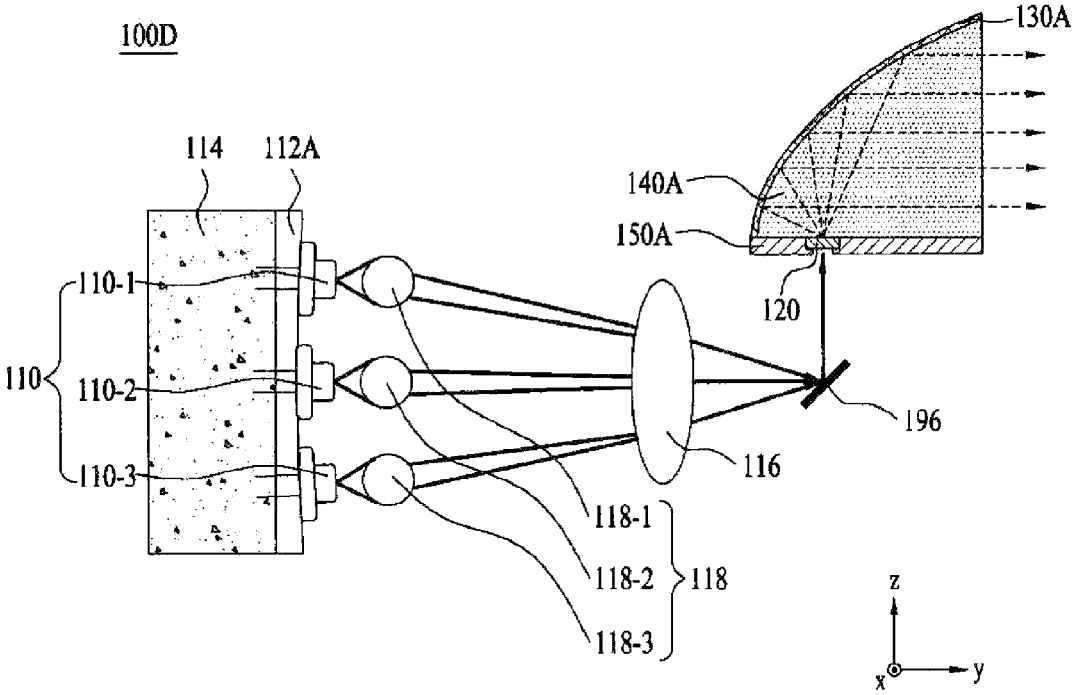
FIG. 15 is a sectional view of a light-emitting apparatus according to another embodiment.
Figure 16:
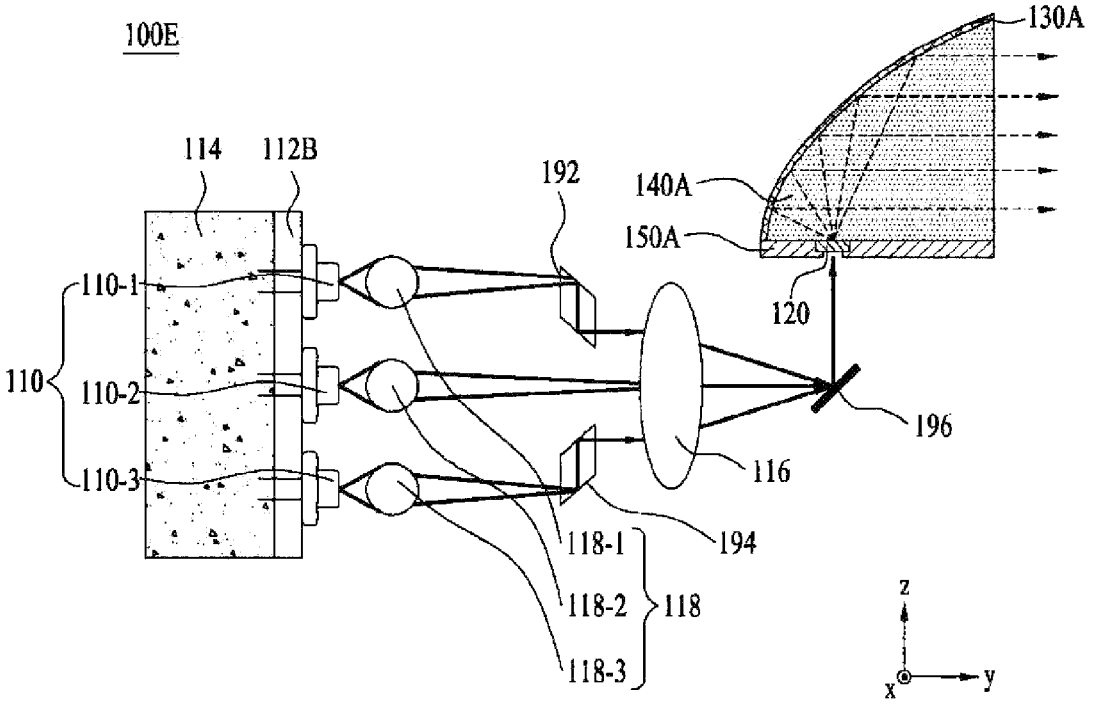
FIG. 16 is a sectional view of a light-emitting apparatus according to another embodiment.
Figure 17:
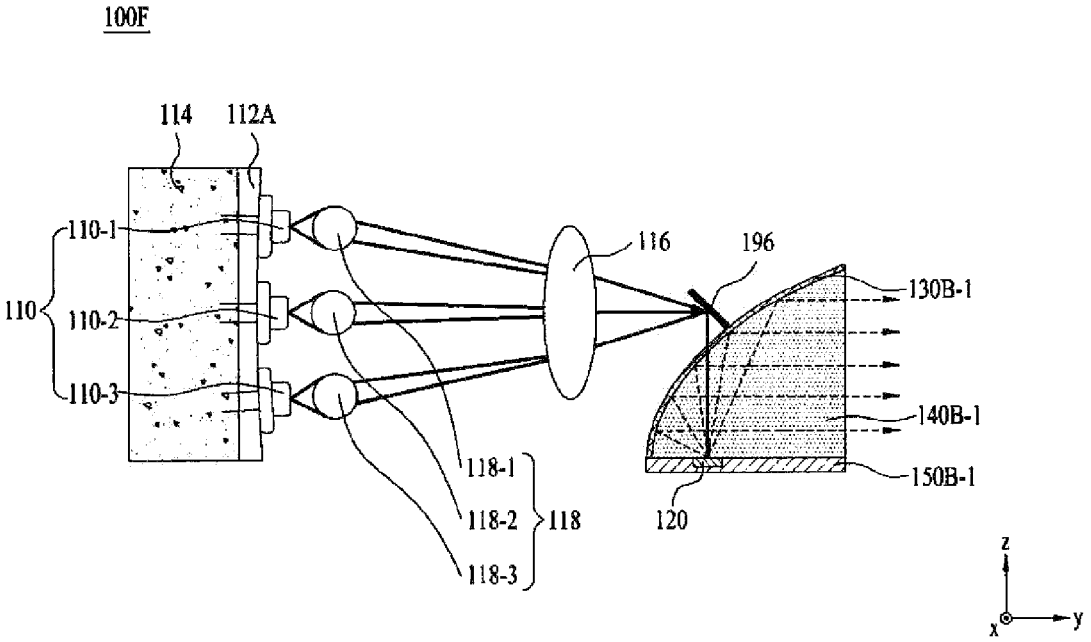
FIG. 17 is a sectional view of a light-emitting apparatus according to another embodiment.
Figure 18:
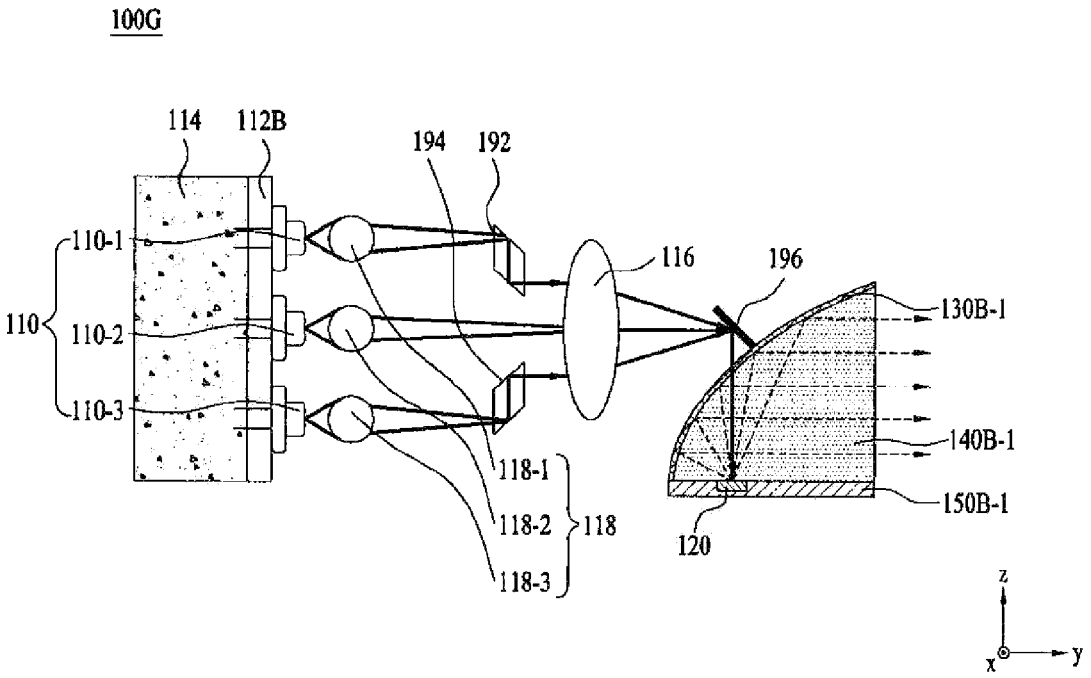
FIG. 18 is a sectional view of a light-emitting apparatus according to a further embodiment.

The light-emitting apparatuses 100D and 100E illustrated in FIGS. 15 and 16 include the light-emitting apparatus 100A illustrated in FIGS. 1 to 3, and the light-emitting apparatuses 100F and 100G illustrated in FIGS. 17 and 18 include the light-emitting apparatus 100B-1 illustrated in FIG. 10, and thus the same parts are designated by the same reference numerals and a repeated description thereof will be omitted. For convenience of description, although the first and second reflective layers 160 and 162 and the first adhesive part 170 are not illustrated in the light-emitting apparatuses 100D to 100G of FIGS. 15 to 17, of course, these components 160, 162 and 170 may be provided.

In addition, the light-emitting apparatuses 100D and 100E illustrated in FIGS. 15 and 16 may include the light-emitting apparatus 100C illustrated in FIGS. 13 and 14 instead of the light-emitting apparatus 100A illustrated in FIGS. 1 to 3.

In addition, the light-emitting apparatuses 100F and 100G illustrated in FIGS. 17 and 18 may include the light-emitting apparatus 100B-2 illustrated in FIG. 12 instead of the light-emitting apparatus 100B-1 illustrated in FIGS. 10 and 11.

Each of the light-emitting apparatuses 100D and 100E illustrated in FIGS. 15 and 16 may include the light-emitting apparatus 100A illustrated in FIGS. 1 to 3, a circuit board 112A or 112B, a radiator 114, a first-first lens 116, a first-second lens 118, and a first mirror 196. In addition, each of the light-emitting apparatuses 100F and 100G illustrated in FIGS. 17 and 18 may include the light-emitting apparatus 100B-1 illustrated in FIG. 10, the circuit board 112A or 112B, the radiator 114, the first-first lens 116, the first-second lens 118, and the first mirror 196.

In FIGS. 15 to 18, the description related to the light-emitting apparatuses 100A and 100B-1 is the same as given above and thus is omitted. However, each of the light-emitting apparatuses 100D, 100E, 100F and 100G illustrated in FIGS. 15 to 18 include a plurality of light sources 110; 110-1, 110-2 and 110-3, and the light sources 110; 110-1, 110-2 and 110-3 are mounted on the circuit board 112A or 112B.

Although the radiator 114 may be attached to the rear surface of the circuit board 112A or 112B so as to outwardly discharge heat generated in the light-emitting apparatus 100A or 100B-1, the embodiment is not limited as to the position of the radiator 114. In another embodiment, the radiator 114 may be attached to the rear surface of the base substrate 150A or 150B-1, in addition to the circuit board 112A or 112B. In still another embodiment, the radiator 114 may be attached only to the rear surface of the base substrate 150A or 150B-1 without being attached to the rear surface of the circuit board 112A or 112B. Alternatively, in some cases, the radiator 114 may be omitted, the radiator 114 may be located on the side surface as well as the rear surface of the circuit board 112A or 112B or the base substrate 150A or 150B-1, or the radiator 114 may be located only on the side surface and not on the rear surface of the circuit board 112A or 112B or the base substrate 150A or 150B-1.

Although the radiator 114 may be formed of aluminum, the radiator 114 may be embodied as, for example, a Thermal Electric Cooler (TEC) in order to achieve higher radiation efficiency. However, the embodiment is not limited as to the position or the constituent material of the radiator 114.

In addition, at least one first lens 116 and/or 118 may focus the light emitted from the light sources 110 so as to emit the light through the first or second through-hole PT1 or PT2.

For example, at least one first lens may include the first-first lens 116 and the first-second lens 118. The first-second lens 118 may include three lenses 118-1, 118-2 and 118-3 which are located respectively between the respective light sources 110-1, 110-2 and 110-3 and the first-first lens 116. That is, the first-second lenses 118 may be provided in the same number as the number, of the light sources 110. The first-second lenses 118; 118-1, 118-2 and 118-3 serve to focus or collimate the light emitted from the light sources 110; 110-1, 110-2 and 110-3. Thus, when the light-emitting apparatus according to any one of the embodiments is applied to a headlight for a vehicle or a flashlight, light may reach very far in a straight line. According to the application, the first-second lenses 118; 118-1, 118-2 and 118-3 may be omitted. That is, when the light emitting device is applied to a traffic light, in order to allow the light emitted from the light-emitting apparatus to spread rather than traveling straight, the first-second lenses 118; 118-1, 118-2 and 118-3 may be omitted.

The first-first lens 116 is located between the first-second lens 118 and the first or second through-hole PT1 or PT2. When the first-second lens 118 is omitted, the first-first lens 116 may be located between the light sources 110; 110-1, 110-2 and 110-3 and the first or second through-hole PT1 or PT2. The first-first lens 116 may be a fθ lens. In the case of a general lens, when the position of a light source is changed, the position on which the light that is generated from the light source and passes through a lens is focused is changed. However, in the case of the fθ lens, even if the position of the light source is changed, the position on which the light having passed through the lens is focused is not changed. Accordingly, the first-first lens 116 may collect the light emitted from the light sources 110-1, 110-2 and 110-3 and transmit the collected light to the first mirror 196.

The first mirror 196 is located between the first-first lens 116 and the first or second through-hole PT1 or PT2 and serves to reflect the light focused by the first-first lens 116 so as to introduce the light to the first or second through-hole PT1 or PT2.

Meanwhile, the surface of the circuit board 112A or 112B, on which the light sources 110; 110-1, 110-2 and 110-3 are mounted, may be a curved surface or a spherical surface as illustrated in FIG. 15 or FIG. 17, or may be a flat surface as illustrated in FIG. 16 or FIG. 18.

Various methods may be used in order to collect the light from the light sources 110. For example, as illustrated in FIGS. 15 and 17, when the surface of the circuit board 112A, on which the light sources 110; 110-1, 110-2 and 110-3 are mounted, is a curved surface or a spherical surface, the light from the light sources 110 may be collected together. When the mounting surface of the circuit board 112A is a spherical surface, the radius of the sphere corresponding to the spherical surface may correspond to the focal distance of the first-second lens 118, which serves as a collimation lens.

However, when the surface of the circuit board 112B, on which the light sources 110; 110-1, 110-2 and 110-3 are mounted, is a flat surface illustrated in FIG. 16 or FIG. 18, in order to collect the light from the light sources together, each of the light-emitting apparatuses 100E and 100G may further include prisms 192 and 194 (or second mirrors or a dichroic coating layer) disposed between the light sources 110 and at least one first lens, namely, between the first-second lenses 118 and the first-first lens 116. Here, the dichroic coating layer may serve to reflect or transmit light in a specific wavelength band.

In addition, optical fibers may be used to collect the light from the light sources 110 together so as to introduce the collected light into the first or second through-hole PT1 or PT2.

Meanwhile, the light-emitting apparatuses according to the above-described embodiments may be applied to various fields. For example, the light-emitting apparatus may be applied in a wide variety of fields such as various lamps for vehicles (e.g. a low beam, a high beam, a tail lamp, a sidelight, a turn signal, a Day Running Light (DRL), and a fog lamp), a flash light, a traffic light, or various other lightings.

Figure 19:
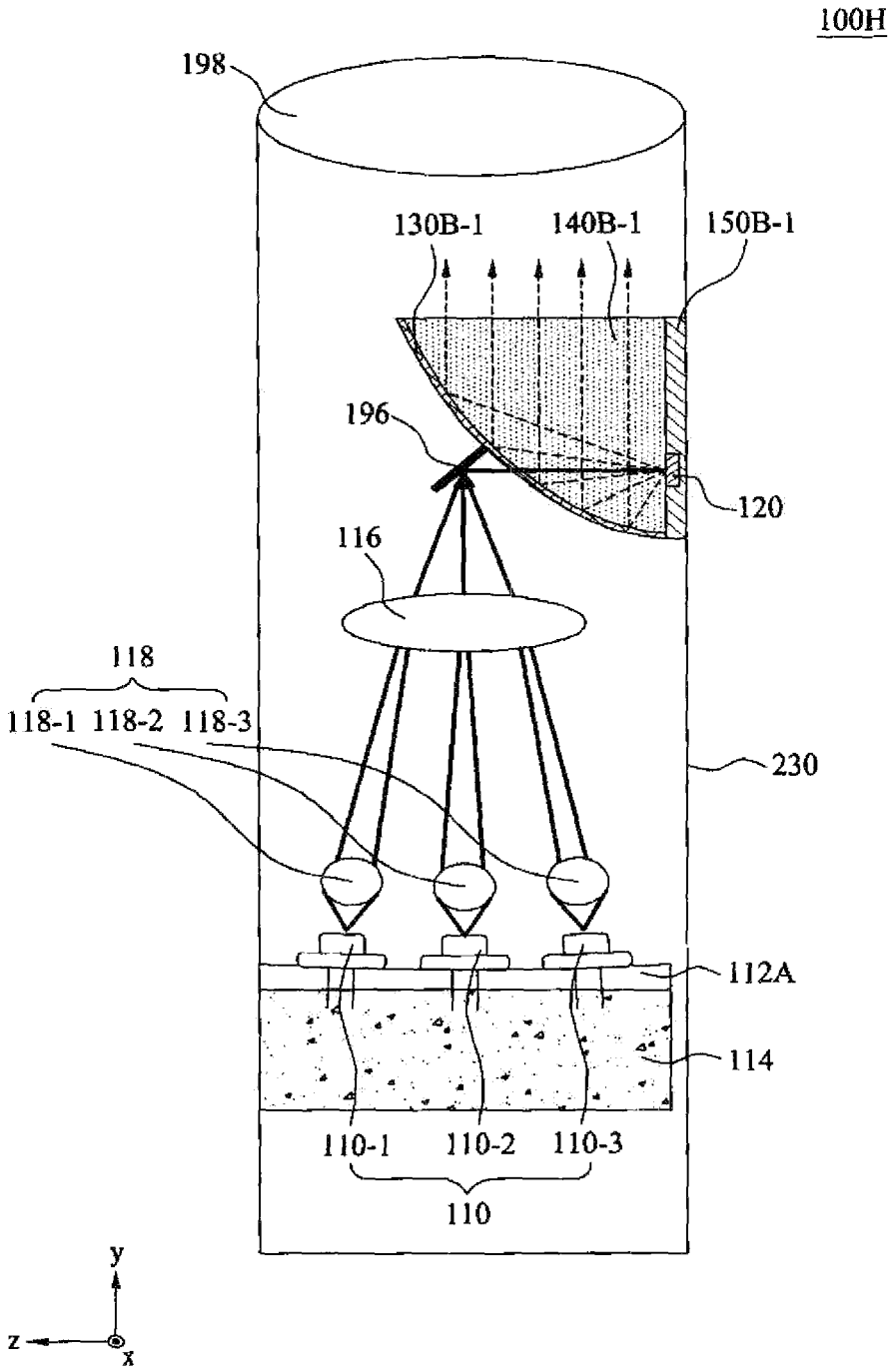
FIG. 19 is a sectional view of a light-emitting apparatus according to one application example.
Figure 20:
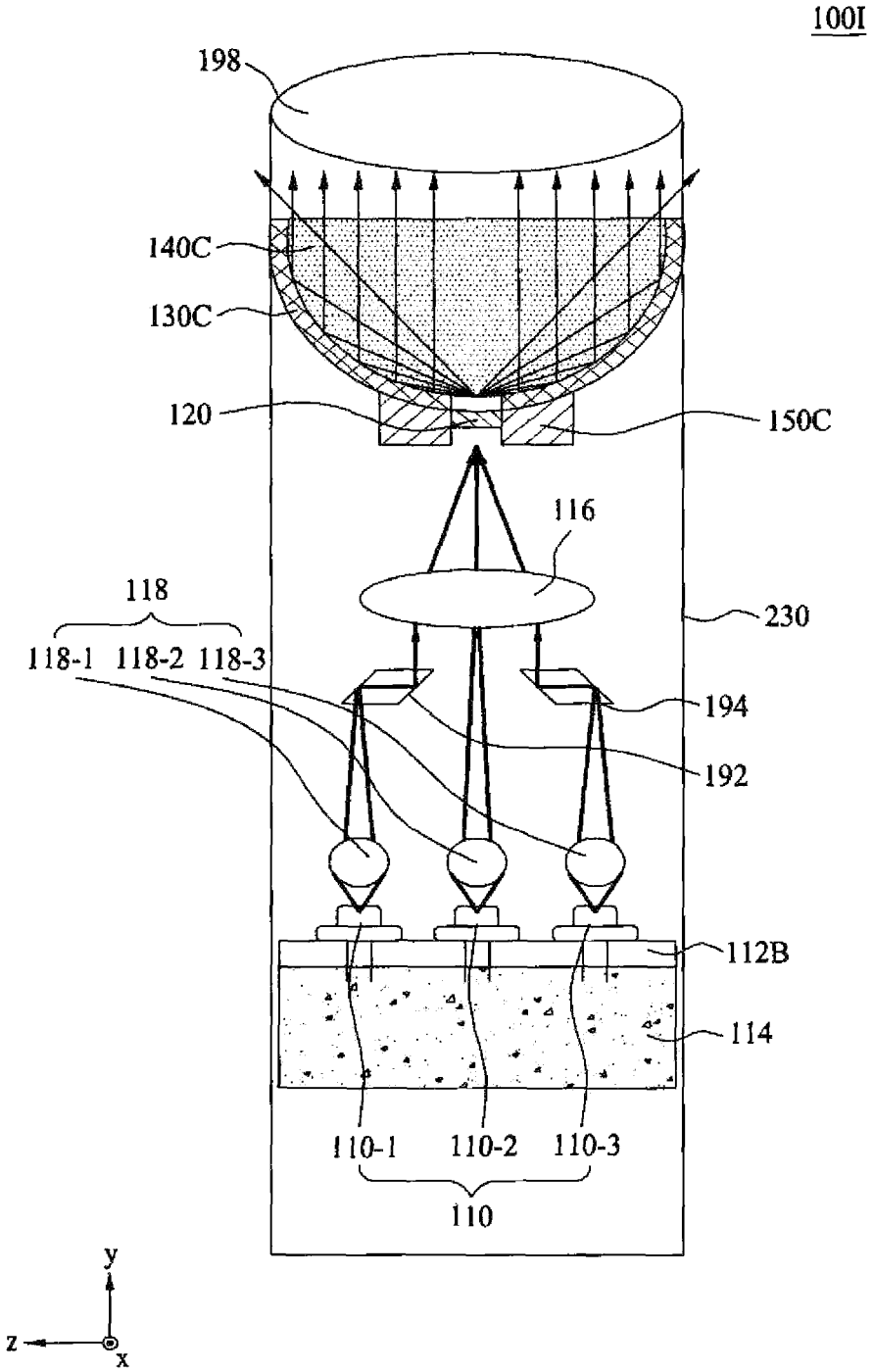
FIG. 20 is a sectional view of a light-emitting apparatus according to another application example.

FIGS. 19 and 20 are sectional views of light-emitting apparatuses 100H and 100I according to one application.

The light-emitting apparatus 100H illustrated in FIG. 19 includes the light emitting apparatus 100F illustrated in FIG. 17, a second lens 198, and a support part 230. The light-emitting apparatus 100I illustrated in FIG. 20 includes the light-emitting apparatus 100C illustrated in FIG. 13, the circuit board 112B, the radiator 114, the first-first lens 116, the first-second lens 118, the prisms 192 and 194 (or the second mirror or the dichroic coating layer), and the support part 230. Here, the light-emitting apparatuses 100B-1 and 100C, the circuit board 112A or 112B, the radiator 114, the first-first lens 116, the first-second lens 118, the first mirror 196, and the prisms 192 and 194 (or the second mirror or the dichroic coating layer) have been described above using the same reference numerals in FIGS. 10, 13 and 17, and thus a repeated description thereof will be omitted below.

The second lens 198 may be disposed to face the third surface S3 of the refractive member 140B-1 or 140C. The support part 230 is the part which may be coupled to at least one of the light source 110, the reflector 130B-1 or 130C, the refractive member 140B-1 or 140C, the base substrate 150B-1 or 150C, the circuit board 112A or 112B, the radiator 114, or the second lens 198 so as to support the same. FIG. 19 illustrates the state in which the circuit board 112A, the radiator 114, the base substrate 150B-1, and the second lens 198 are supported by the support part 230. In addition, although FIG. 20 illustrates that only the second lens 198 and the reflector 130C are supported by the support part 230, of course, at least one of the various lenses 116, 118, 192 and 194, the circuit board 112B, the radiator 114, or the base substrate 150C may be supported by the support part 230.

After the components corresponding to the light-emitting apparatus 100H or 100I are primarily supported by the support part 230 as illustrated in FIGS. 19 and 20, the components may be secondarily fixed using, for example, epoxy or resin. However, the embodiment is not limited as to the method for fixing the respective components of the light-emitting apparatuses 100H and 100I.

The light-emitting apparatuses 100H and 100I illustrated in FIGS. 19 and 20 are merely given by way of example, and the light-emitting apparatus 100A illustrated in FIGS. 1 to 3 and the light-emitting apparatus 100B-2 illustrated in FIG. 13 may also be coupled to and supported by the support part 230 as illustrated in FIGS. 19 and 20.

In addition, the second lens 198 illustrated in FIGS. 19 and 20 may be omitted according to the design of the reflectors 130B-1 and 130C.

In conclusion, the light-emitting apparatuses 100A to 100I according to the above-described embodiments convert the wavelength of light excited by the light source 110 using the wavelength converter 120 so as to have a desired color and color temperature, and thereafter direct the light to the reflector 130A to 130C through the refractive member 140A to 140C without passing through an air layer.

Generally, light may undergo total internal reflection due to the difference in the index of refraction between materials when the light travels from a material having a high index of refraction to a material having a low index of refraction. When the difference in the index of refraction between the materials is great, the probability of total internal reflection increases, thereby reducing the efficiency with which the light is extracted outward. In consideration of this, in the case of the light-emitting apparatuses 100A to 100I according to the embodiments, the light, reflected by or transmitted through the wavelength converter 120, is directed to travel to the reflector 130A to 130C through the refractive member 140A to 140C instead of the air layer, and in turn the light reflected by the reflector 130A to 130C is emitted to the air through the third surface S3 of the refractive member 140A to 140C without passing through the air layer. That is, in the case of the light-emitting apparatuses 100A to 100I according to the embodiments, no air layer is present between the refractive member 140A to 140C and the reflector 130A to 130C, and no air layer is present between the refractive member 140A to 140B-2 and the base substrate 150A to 150B-2. As such, the light extraction efficiency may be enhanced, and the distribution of light to be emitted, i.e. the illuminance distribution may be adjusted in a desired manner.

Figure 21:
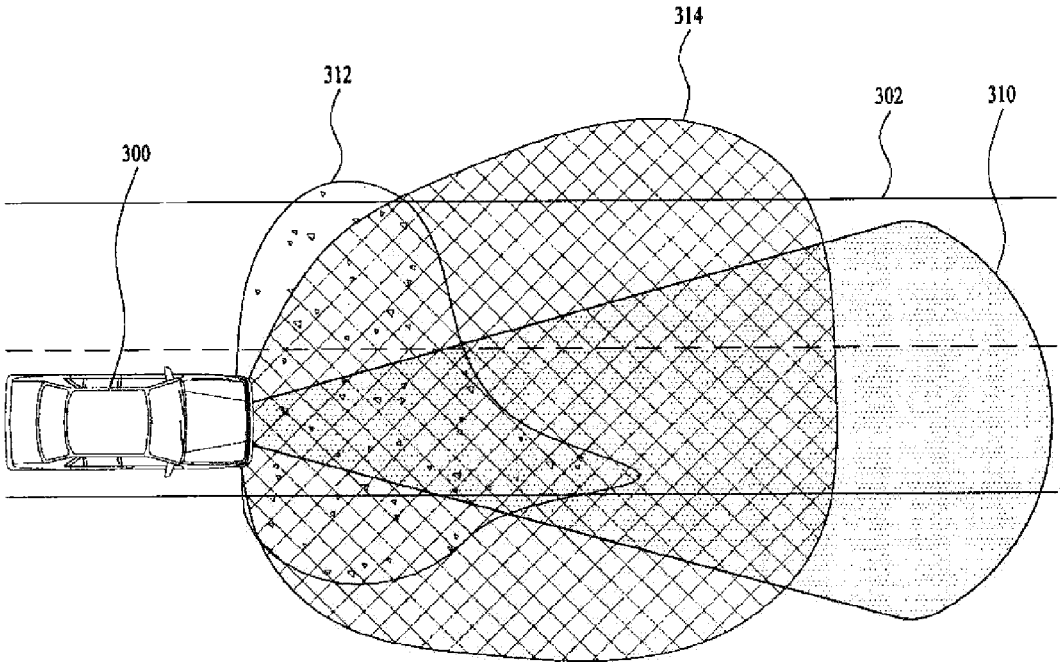
FIG. 21 is a view illustrating the illuminance distribution of light in the case where the light-emitting apparatus according to an embodiment is applied to a headlight for a vehicle.

FIG. 21 is a view illustrating the illuminance distribution of light in the case where any one of the light-emitting apparatuses 100A to 100I according to the embodiments is applied to a headlight for a vehicle.

Referring to FIG. 21, in the state in which a vehicle 300 travels on a road 302, the light-emitting apparatuses 100A to 100I according to the embodiments, which have high light extraction efficiency, may emit light that travels straight so as to achieve light distribution 310 that allows the light to reach very far, for example, a distance of 600 m from the vehicle 300. In this case, the light-emitting apparatuses 100A to 100I according to the embodiments may be applied to assist a high beam of a vehicle in connection with an Advanced Driving Assistance System (ADAS) by realizing spot beams for remote target lighting. However, the embodiments are not limited thereto, and the light-emitting apparatuses 100A to 100I according to the embodiments may be used to emit light having short-distance light distribution 312 or 314. For example, light may be collected to be emitted very far in a straight direction, or may spread to be emitted to a short distance according to the shape of the reflector 130A to 130C or the kind of lens, which may vary widely.

In addition, when the reflector 130A to 130C is integrated with the refractive member 140A to 140C, the size of the entire light-emitting apparatus 100A to 100I may be reduced. Through a reduction in the size of the light-emitting apparatus 100A to 100I, the freedom in design may be increased when the light-emitting apparatus 100A to 100I is applied to lighting for a vehicle or a general lamp such as a flash light. In addition, the reduced size of the light-emitting apparatus 100A to 100I may ensure portability and ease in handling.

In addition, as the refractive member 140A to 140C is formed of a material having high thermal conductivity, the refractive member may realize the efficient radiation of heat generated from the wavelength converter 120, thereby achieving excellent radiation effects.

In addition, as exemplarily illustrated in FIGS. 1 to 3 or FIGS. 9 to 12, the reflector 130A, 130B-1 or 130B-2 may be supported by the refractive member 140A, 140B-1 or 140B-2 and the shape of the reflector 130C may be maintained by the refractive member 140C as exemplarily illustrated in FIGS. 13 and 14, which may allow the reflectors 130A to 130C to be easily fabricated to have various shapes. For example, the reflectors 130A to 130C may have fine patterns or facets.

Hereinafter, although a method for fabricating the above-described refractive member 140A, 140B-1 or 140B-2 will be described with reference to the accompanying drawings, the refractive member 140A, 140B-1 or 140B-2 may be fabricated via various other methods.

Figure 22A:
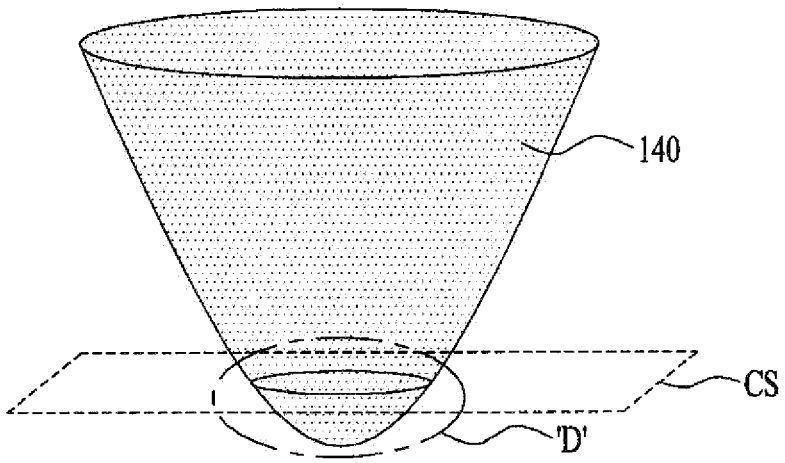
FIGS. 22A and 22B are views to explain a method for fabricating the refractive member according to an embodiment.
Figure 22B:
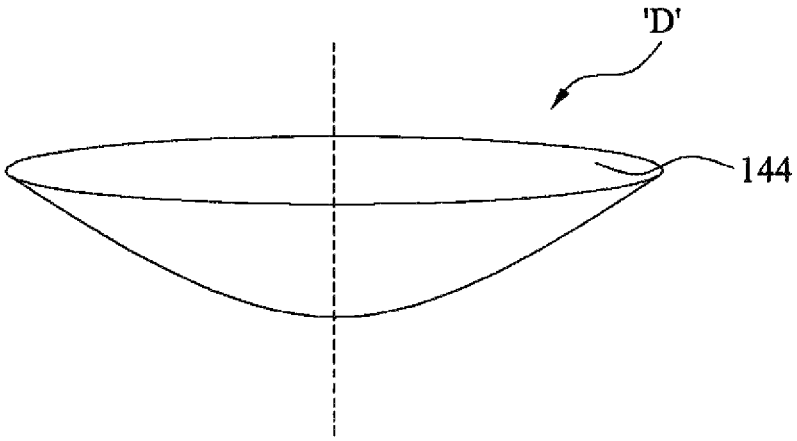

FIGS. 22A and 22B are views to explain the method for fabricating the refractive member 140A, 140B-1 or 140B-2 described above, according to an embodiment.

First, a refractive material 140 is prepared as exemplarily illustrated in FIG. 22A. The refractive material 140, as described above, may comprise at least one of $Al_2O_3$ single crystals, $Al_2O_3$ or $SiO_2$ glass, although the embodiment is not limited thereto.

Subsequently, as exemplarily illustrated in FIG. 22B, the lower end part of the refractive material 140 of the portion "D" illustrated in FIG. 22A is cut to acquire a refractive member 144 as illustrated in FIG. 22B. Here, the reference numeral CS represents a cut cross-section. Here, the acquired refractive member 144 may be the refractive member 140A illustrated in FIGS. 1 to 3, or may be the refractive member 140B-1 or 140B-2 illustrated in FIGS. 9 to 12.

As is apparent from the above description, light-emitting apparatuses according to the embodiments may achieve excellent light extraction efficiency, may adjust the distribution of light to be emitted, i.e. the illuminance distribution in a desired manner, may increase the freedom in design when applied to lighting, for a vehicle or a general lamp such as a flash light owing to a reduction in the entire size thereof, may ensure portability and ease in handling owing to the reduced size, and may exhibit excellent heat radiation effects.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A light-emitting apparatus comprising:

at least one light source;

a wavelength converter configured to convert a wavelength of light emitted from the light source;

a reflector configured to reflect the light having the wavelength converted in the wavelength converter and light having an unconverted wavelength;

a refractive member disposed in a light passage space between the reflector and the wavelength converter, the refractive member being configured to emit the reflected light; and a base substrate disposed to be opposite to the reflector, wherein the refractive member includes:

a rounded first surface disposed to face the reflector;

a second surface having a first portion disposed to face the wavelength converter, and a second portion excluding the first portion; and a third surface for emission of the reflected light, wherein the base substrate includes first and second areas adjacent to each other, wherein the first area corresponds to an area excluding the second area, or the first area corresponds to an area facing the second portion of the second surface of the refractive member, and wherein the second area corresponds to an area, in which the wavelength converter is disposed.

2. The apparatus according to claim 1, wherein the base substrate is disposed to be opposite to the reflector with the refractive member interposed therebetween.

3. The apparatus according to claim 1, wherein the second area of the base substrate includes a first through-hole for passage of the light emitted from the light source, and the wavelength converter is located in the first through-hole.

4. The apparatus according to claim 1, wherein the reflector includes a second through-hole for passage of the light emitted from the light source.

5. The apparatus according to claim 3, wherein the first through-hole is located closer to the first surface of the refractive member than the third surface.

6. The apparatus according to claim 4, wherein the reflector has one end coming into contact with the third surface of the refractive member and the other end coming into contact with the base substrate, and a first distance from the second through-hole to the one end of the reflector is greater than a second distance from the second through-hole to the other end of the reflector.

7. The apparatus according to claim 1, further comprising a first reflective layer disposed between at least a part of the second portion of the refractive member and the first area of the base substrate.

8. The apparatus according to claim 4, wherein the second area of the base substrate includes a recess for arrangement of the wavelength converter.

9. The apparatus according to claim 8, further comprising a second reflective layer disposed in the recess between the wavelength converter and the base substrate.

10. The apparatus according to claim 4, wherein the wavelength converter is disposed on the second area of the base substrate so as to be rotatable to face the second through-hole.

11. The apparatus according to claim 1, wherein at least one of the second portion of the refractive member and the first area of the base substrate has a pattern.

12. The apparatus according to claim 1, wherein the reflector and the refractive member are integrated with each other.

13. The apparatus according to claim 1, further comprising an anti-reflective film disposed on the third surface of the refractive member.

14. The apparatus according to claim 1, wherein the reflector includes a metal layer coated on the first surface of the refractive member.

15. The apparatus according to claim 1, further comprising a first adhesive part disposed between the first portion of the second surface of the refractive member and the wavelength converter.

16. The apparatus according to claim 1, further comprising a second adhesive part disposed between the second portion of the second surface of the refractive member and the first area of the base substrate.

17. The apparatus according to claim 1, wherein the at least one light source includes, a plurality of light sources, and wherein the light-emitting apparatus further comprises a circuit board for mounting of the light sources.

18. The apparatus according to claim 17, further comprising a radiator attached to a rear surface of the circuit board or a rear surface of the base substrate.

19. The apparatus according to claim 17, further comprising:

at least one lens unit configured to focus light emitted from the plurality of light sources and to emit the focused light through the first or second through-hole; and a mirroring unit arranged between the at least one lens unit and the first or second through-hole, the mirroring unit being configured to reflect the focused light from the at least one lens unit and to provide the reflected light into the first or second through-hole.

20. The apparatus according to claim 19, wherein the at least one lens unit comprises a first sub lens and a second sub lens, wherein the first sub, lens is arranged between the second sub lens and the first or second through-hole, wherein a number of the second sub lens is equal to a number of the plurality of light sources, and wherein each of the second sub lens is arranged between each of the plurality of light sources and the first sub lens.

* * * * *